US010775133B2

(12) United States Patent
Higdon, Jr.

(10) Patent No.: US 10,775,133 B2
(45) Date of Patent: Sep. 15, 2020

(54) MULTI-PURPOSE CARRIER

(71) Applicant: Albert Gene Higdon, Jr., Hubert, NC (US)

(72) Inventor: Albert Gene Higdon, Jr., Hubert, NC (US)

( * ) Notice: Subject to any disclaimer, the term of this patent is extended or adjusted under 35 U.S.C. 154(b) by 0 days.

(21) Appl. No.: 16/431,873

(22) Filed: Jun. 5, 2019

(65) Prior Publication Data

US 2019/0323797 A1 Oct. 24, 2019

Related U.S. Application Data

(62) Division of application No. 15/594,818, filed on May 15, 2017, now Pat. No. 10,352,652.

(60) Provisional application No. 62/401,360, filed on Sep. 29, 2016, provisional application No. 62/342,652, filed on May 27, 2016.

(51) Int. Cl.
*F41C 33/04* (2006.01)
*F41C 33/02* (2006.01)
*F42B 39/02* (2006.01)

(52) U.S. Cl.
CPC ..... *F41C 33/046* (2013.01); *F41C 33/0209* (2013.01); *F41C 33/0236* (2013.01); *F42B 39/02* (2013.01)

(58) Field of Classification Search
CPC .. F41C 33/02; F41C 33/0209; F41C 33/0218; F41C 33/0227; F41C 33/0236; F41C 33/0272; F41C 33/0281; F41C 33/029; F41C 33/04; F41C 33/041; F41C 33/043; F41C 33/045; F41C 33/046; F41C 33/048; F41C 33/06
USPC ..... 224/192–193, 198, 238, 243, 911–912; D3/222–223
See application file for complete search history.

(56) References Cited

U.S. PATENT DOCUMENTS 3,630,420 A * 12/1971 Bianchi ..... F41C 33/0209 224/193
4,307,825 A * 12/1981 Pattermann ..... A45F 5/02 224/231
5,215,238 A * 6/1993 Baruch ..... F41A 17/54 224/243
2015/0192387 A1* 7/2015 Thompson ..... F41C 33/0209 224/243

* cited by examiner

*Primary Examiner* — Scott T McNurlen
(74) *Attorney, Agent, or Firm* — Intellectual Property Consulting, LLC; Stephen Kepper

(57) ABSTRACT

A multi-purpose carrier constructed from a single continuous sheet of material that is folded along a central vertical axis to create opposing top open ends and opposing bottom open ends wherein the left and right sides are further folded towards the central vertical axis to create opposing side walls with a channel at the outer edge of each of the side walls. A torsion spring is funneled through the channels to compress the opposing sides of the device together to create a positive compression grip on the contents carried in the carrier.

3 Claims, 26 Drawing Sheets

MULTI-PURPOSE CARRIER

RELATED APPLICATIONS

This application is a division of U.S. application Ser. No. 15/594,818, filed May 15, 2017, which claims priority to U.S. Provisional Application No. 62/342,652 filed May 27, 2016 and U.S. Provisional Application No. 62/401,360 filed Sep. 29, 2016. The entire contents of the above applications are hereby incorporated by reference as though fully set forth herein.

FIELD

The present invention relates to the field of weapons. More specifically, the present invention relates to carriers for firearm and firearm accessories.

BACKGROUND

It is often desired to carry accessories and firearms. For example, a spare magazine is typically carried on the person on a belt, jacket or other device worn on the body. When replacing the magazine for the firearm, the old magazine is removed from the firearm and a new magazine is retrieved from the spare magazine carrier before it can be inserted in place.

There are known firearm and accessory carriers made from nylon or other nylon like products, which uses are more catered for outdoor uses in tactical environments such as military, law enforcement and shooting enthusiast usage. Professionals in a non-tactical environment such as detectives, personal bodyguards, special agents or similar professions often have to dress up in suits or nice casual clothing where nylon products such as holsters, belts and magazine carriers stand out within the normal realm of public locations. As such, firearm and accessory carriers that are made of nylon-type materials present themselves to be more noticeable in public.

Leather pouches have been used as long as man has existed. As such the public merely dismisses the existence of a leather carrier in public view thinking the carrier contains a pocketknife or a tool such as a multi-tool (i.e. Leatherman, small flashlight). Accordingly, there is a long felt need for various types of pistol, handgun or rifle holster and accessory carriers that can be made to match a leather belt that one wears. This allows the carrier to be made in colors that better blend into the user's garments and style of dress so as to be less noticeable.

Nylon-like pouches, holsters and carriers can maintain a positive grip to the contents of what it carries but they cannot mold or remold themselves like a leather carrier. Similarly, thermoplastic acrylic-polyvinyl chloride based or molded injection carriers that are typically secured with a bungee or other type cord cannot change their shape without extensive modifications. As such, there is a need for adjustable carriers than can be reshaped and/or molded easily with use of water or with products used in the leather profession to mold leather, which can be easily obtained by the user.

PRIOR ART

Most carriers on the market use an elastic cord, most commonly called bungee or shock cord, to provide an open top, positive compression/retention design. It would be useful for this design to have more versatility, such as using a torsion spring to obtain the positive compression grip to maintain the contents of the carrier rather than the elastic cord.

Known carriers are constructed with multiple parts. Most have a main body which folds in the center to provide a left and right side as well as additional front and back pieces. These carriers also often use a bracket made of plastic-like material or reinforced nylon webbing, which is secured in the middle of the main body at its fold that creates the sides. Then an elastic cord weaves the opposing sides together in order to provide the compression of its contents. Such carriers often have webbing that is sewn onto the main body to accept the elastic cord and to also be used in conjunction with other securing devices to attach themselves to a platform most commonly referred to as MOLLE (modular, lightweight, load carrying equipment) webbing. MOLLE webbing is most commonly used in military and some law enforcement equipment and is therefore not necessary for non-tactical uses, such as for law enforcement, contractors, lawyers, doctors and others wherein their workplace and wardrobe dictates their apparel to be worn. As such, it would be useful to have a leather carrier without such webbing. Further, most carriers require lamination of multiple layers, which requires extensive sewing.

It would be considerably more cost effective in materials and labor if a carrier is constructed from only one piece of material for the front, back and sides. It would also be more cost effective if the design did not require lamination of multiple layers or use of webbing. Finally, such a design would result in a smoother surface so as to reduce or eliminate its propensity to get caught up or snag onto anything it comes into contact with.

BRIEF SUMMARY OF THE INVENTION

It is an object of the present invention to meet these needs by providing a multi-purpose carrier with simple construction made from a material that allows the user to discreetly carry a firearm or a tactical accessory that does not rely solely on an elastic band to obtain the positive compression grip to maintain the content of the carrier. According to one embodiment of the carrier disclosed herein, a single continuous sheet of material in an "H" or "I" shape is folded along a horizontal axis in a manner so as to create opposing open top ends and a closed bottom end. The opposing left and right sides are folded towards a vertical axis in the center of the sheet of material to create opposing left and right channels. The channels have a plurality of apertures located along the outer edge of the channels. A cord can be funneled through the channels and apertures to weave the opposing sides of the device together to create a positive compression grip of the contents carried in the carrier, such as an elastic or bungee cord. A strap may be attached to one of the top open ends, folded back on itself and secured to one of the sides to create a loop for a belt or other securing device to pass through and secure the carrier to the user's body.

In another embodiment of the present invention, a single continuous sheet of material is folded along a vertical axis to create opposing open top ends and opposing open bottom ends. The opposing left and right sides are folded towards the center of the sheet of material to create opposing channels. A strap may be attached to one of the top open ends, folded back on itself and secured to one of the sides to create a loop for a belt or other securing device to pass through and secure the carrier to the user's body. A strap may be attached to one of the bottom open ends and secured to each of the sides to secure the bottom open end and prevent the item contained in the carrier from slippage out the bottom open end.

In another embodiment of the present invention, a pair of torsion springs are inserted into the formed channels on each side of the carrier created by the horizontally folded carrier and the springs may enter from the bottom of the carrier and pass through the side channels towards the top of the carrier. A first torsion spring may also be inserted into the single formed channel on one side of the carrier created by the vertically folded carrier and the spring may enter from the bottom of the carrier and pass through the side channels towards the top of the carrier. Alternatively, a second torsion spring may also be inserted into the single formed channel on one side of the carrier created by the vertically folded carrier and the spring may enter from the top of the carrier and pass through the side channels towards the bottom of the carrier. The first and second torsion spring may interlock along the side of the carrier with the single formed channel.

In an exemplary embodiment, the torsion spring has a "W" or "M" shaped end with two opposing limbs extruding therefrom. The limbs of the torsion spring may have a curvature midway that inserts into the apertures of the channels of the horizontally folded carrier, locking the limbs into place in the carrier. The end of the torsion spring may have turn back hooks that pass completely through the channels of the horizontally folded carrier and out the open top end of the carrier to help lock the spring in place. In another embodiment, the end of the torsion spring can also be complete loop, similar to eyelets on a fishing hook.

Additionally, an elastic or rubber band like O-ring can be inserted onto the limbs of the torsion spring at the midway point or midway curvatures to help lock the spring into place within the channel apertures of the horizontally folded carrier, which assists in the compression of the carrier against the contents carried within.

In additional embodiments of the present invention, the carrier is constructed to have tooling designs that match the current equipment that most police and sheriff department regulations mandate. Additionally, a leather loop may be attached to secure itself to a belt or can be constructed for use with other manufacturers' parts to secure itself to other platforms such as paddles or slide on belt hangers. In another embodiment, the belt clip may be inserted through the one side of the channels at either the top end of the channels or at the apertures in the sides of the channels such that the height of the carrier above the belt is adjustable.

In the preferred embodiment the material used in the construction of the carrier is leather. While, leather does require more care to preserve the all-natural material, the material of the present invention is not restricted to leather as it can also be made from other materials such as polyvinyl chloride (PVC) or chlorosulfonated polyethylene (CSPE) synthetic rubber or can be injection molded.

DETAILED DESCRIPTION

Figure 1:
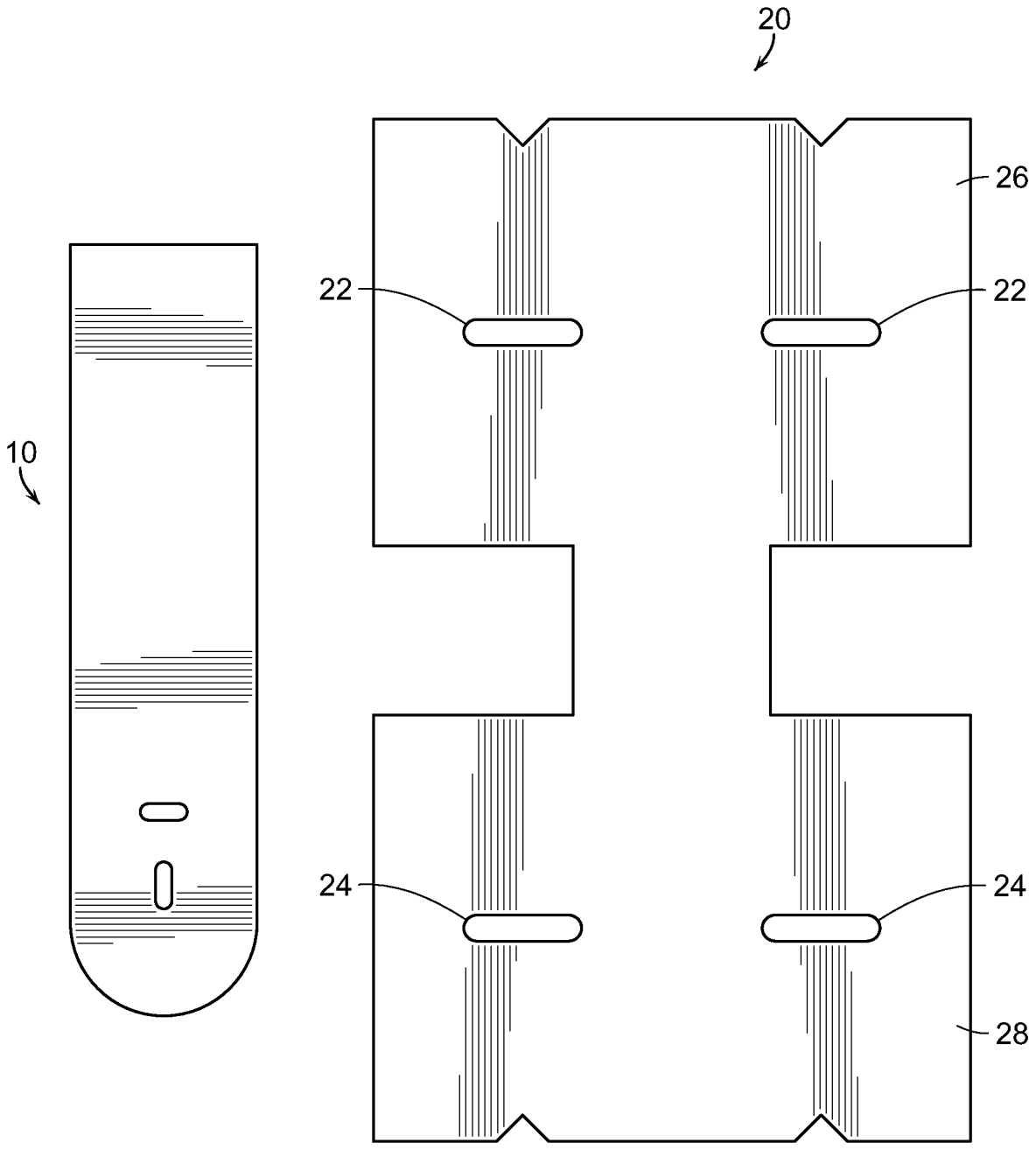
FIG. 1 is a front view of one embodiment of the pattern for the single continuous sheet of material for one embodiment of the present invention.
Figure 2:
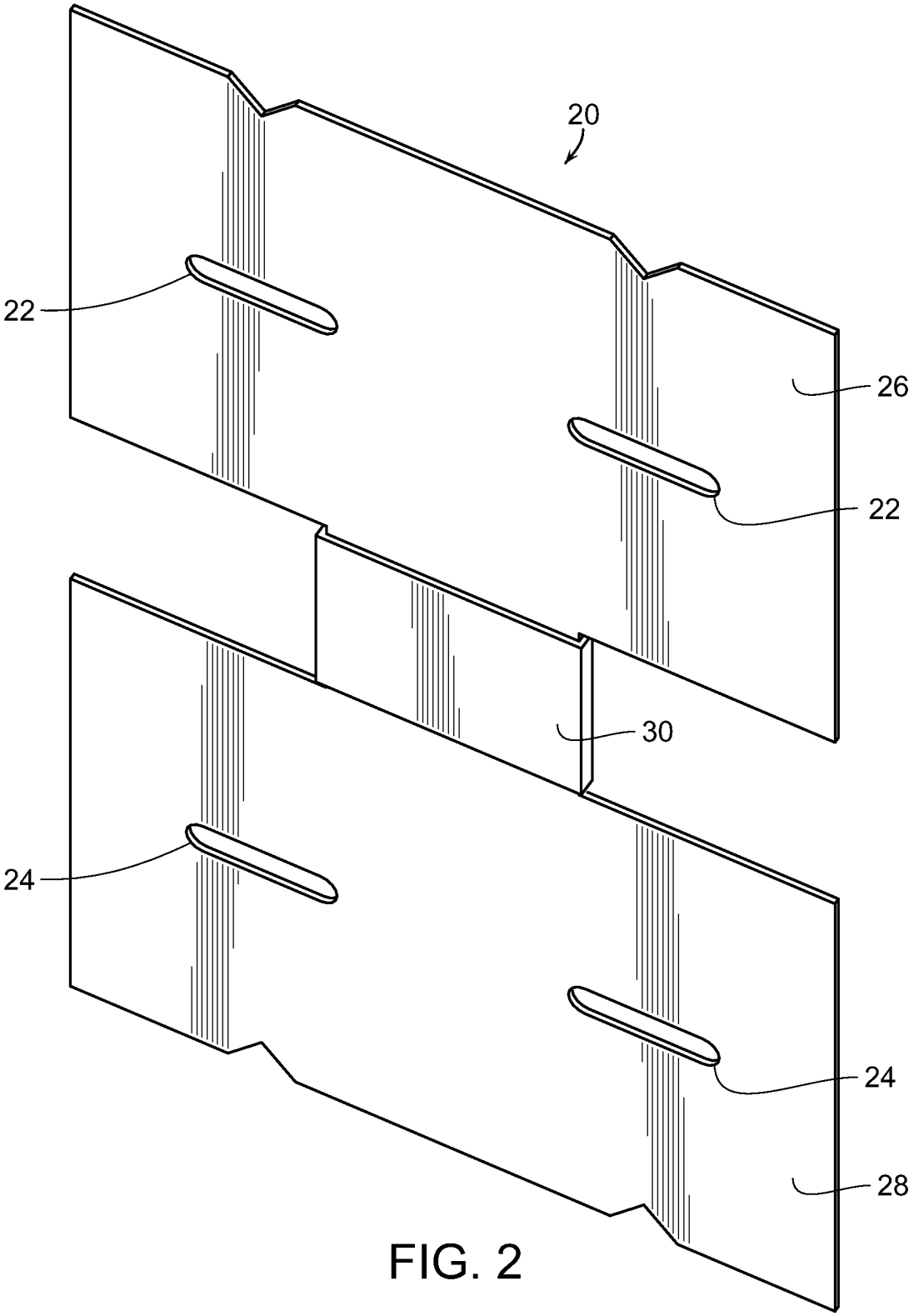
FIG. 2 is perspective side view of a partially assembled carrier from the pattern shown in FIG. 1.

Turning to FIG. 1, one embodiment of the pattern used to cut the material of the carrier 20 is shown wherein the pattern is generally "H" or "I" shaped, depending on orientation. As shown, the pattern is "I" shaped. The top portion 26 and bottom portion 28 are substantially rectangular pieces connected by a substantially rectangular connector piece 30. As shown in FIG. 2, the first substantially rectangular connector piece 30 may be reinforced with a second substantially rectangular connector piece. The top and bottom portions 26 and 28, respectively, have apertures 22 and 24. A strap portion 10 is substantially elongated rectangular shape with a curved end with a plurality of apertures.

Figure 3:
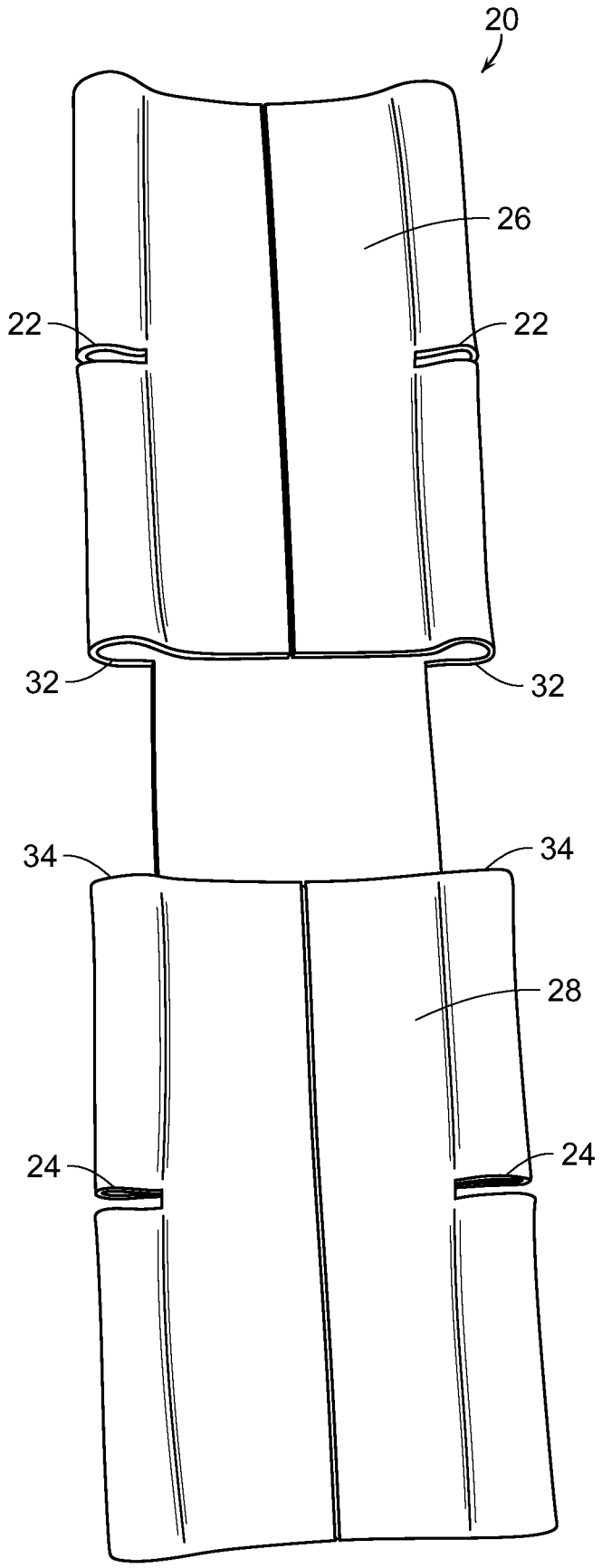
FIG. 3 is a front view of the inside of a partially assembled carrier from the pattern shown in FIG. 1.
Figure 4:
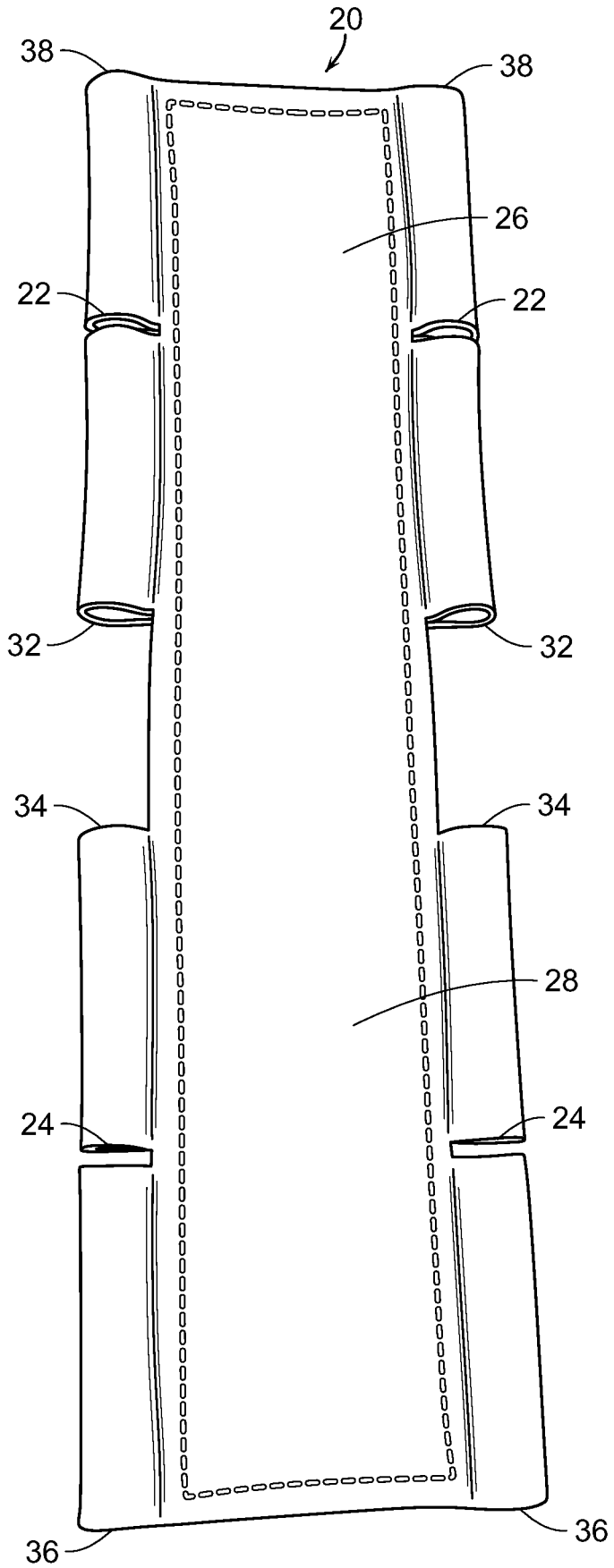
FIG. 4 is a back view of the outside of a partially assembled carrier from the pattern shown in FIG. 1.

Turning to FIGS. 3 and 4, the top portion 26 and bottom portion 28 of the carrier 20 are folded along their interior surface to meet a medial vertical axis of the pattern to create channels 32 and 34. The apertures in the top and bottom portions create slots 22 and 24 along the edges of channels 32 and 34. The channels 32 and 34 are secured in place by stitching the folded pieces of the top portion 26 and bottom portion 28 using a seam. The second connector piece may also be stitched into place using a seam.

Figure 5:
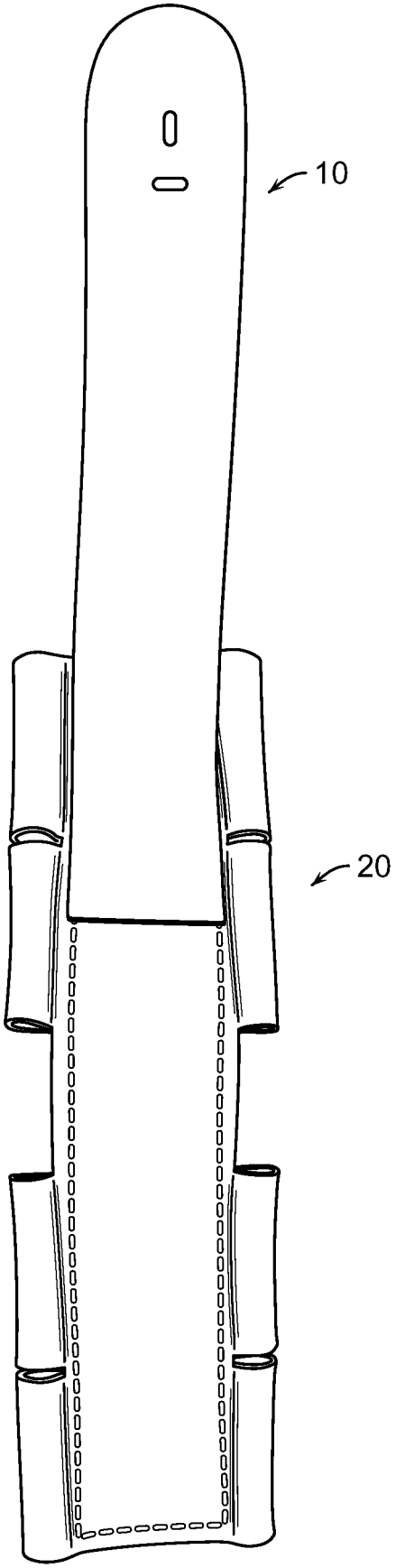
FIG. 5 is a back view of a partially assembled carrier from the pattern shown in FIG. 1.
Figure 7:
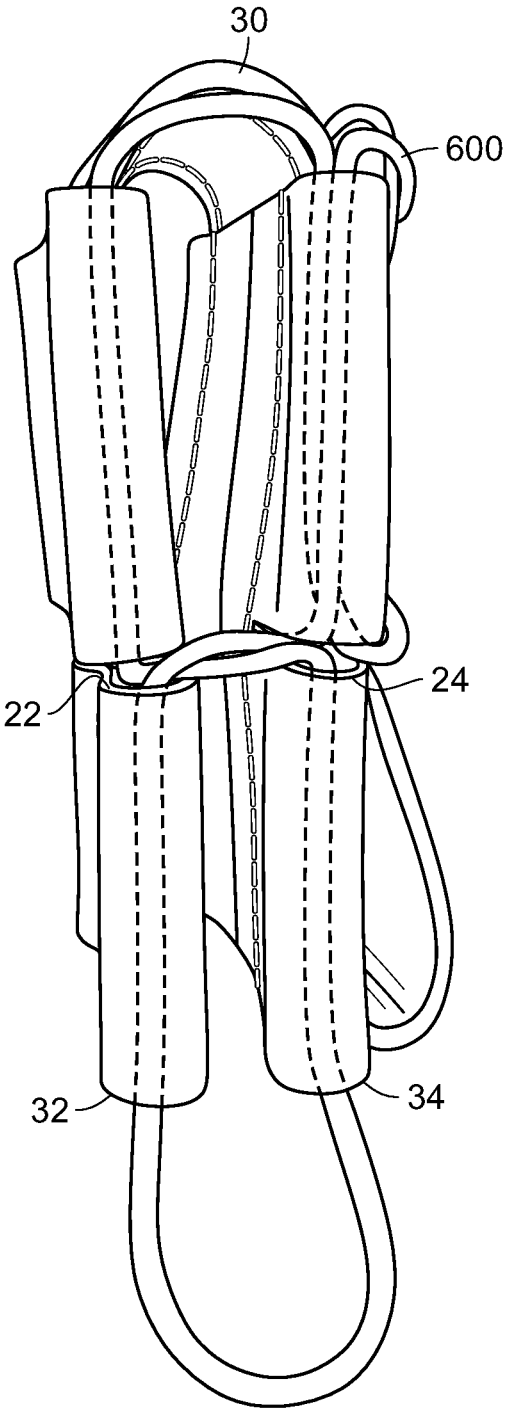
FIG. 7 is a side view of a fully assembled carrier from the pattern shown in FIG. 1.
Figure 8:
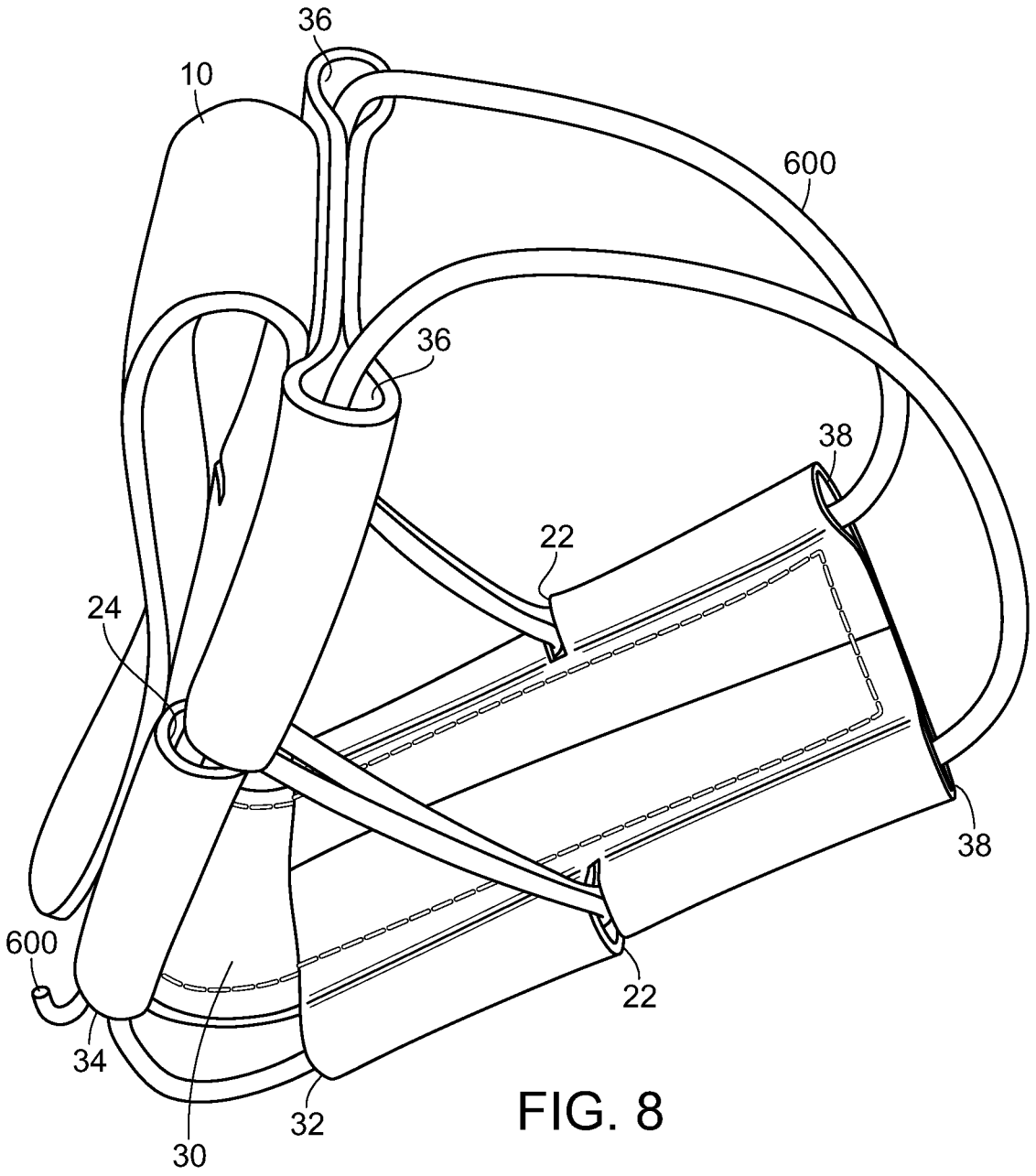
FIG. 8 is a perspective side view of a fully assembled carrier from the pattern shown in FIG. 1.
Figure 9:
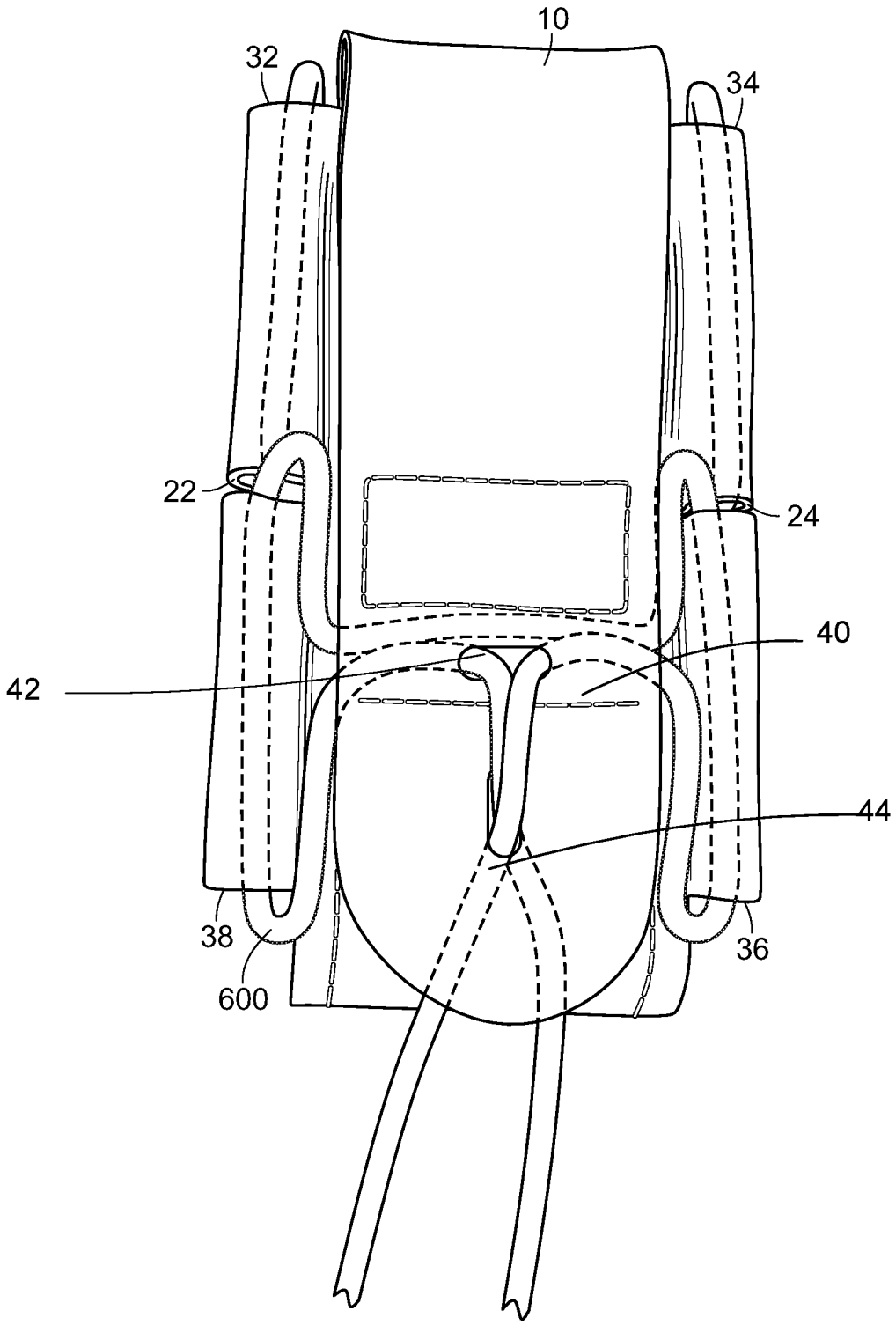
FIG. 9 is a back view of a fully assembled carrier from the pattern shown in FIG. 1.

Turning to FIG. 5, the strap portion 10 is attached to the top portion of the carrier 20. In FIGS. 6-9 the strap portion 10 is folded back on itself to create a loop and stitched into place. Turning to FIGS. 7-9, on the strap portion 10 between the two places where it is sewn, there is what forms a channel 40 and a horizontal hole 42. The cord 600 passes through the channel 40 to create two equal lengths of cord 600 on each side. The two equal lengths of cord 600 (one left and one right side) are inserted on their respective sides, downward to the first opening 36/38 and proceed upwards through the channels towards 22/24. The cord then exits 22/24 and proceeds to the opposite sides of 22/24, then the cord goes upwards through the channels 32/34 until they exit the top of the channels 32/34. Then the cord transfers back to the opposite side (Front to backside) 32/34 opening back through channels to 22/24, then exits to transfer into the opening 22/24 going downwards till they exit 36/38. Then the cord goes back up 36/38 (Front to back side) then back upwards to 22/24 where the cord exits. Then the tails of the cord 600 pass back downwards from 22/24 and back through channel 40 where the lacing pattern began. The cords exit midway through the channel 40 and out the hole 42. Both cord ends now pass through the vertical hole 44 below the channel 40 to assist in securing/locking the cord 600 into place. A sufficient amount of cord 600 is left hanging for future adjustment.

Figure 6:
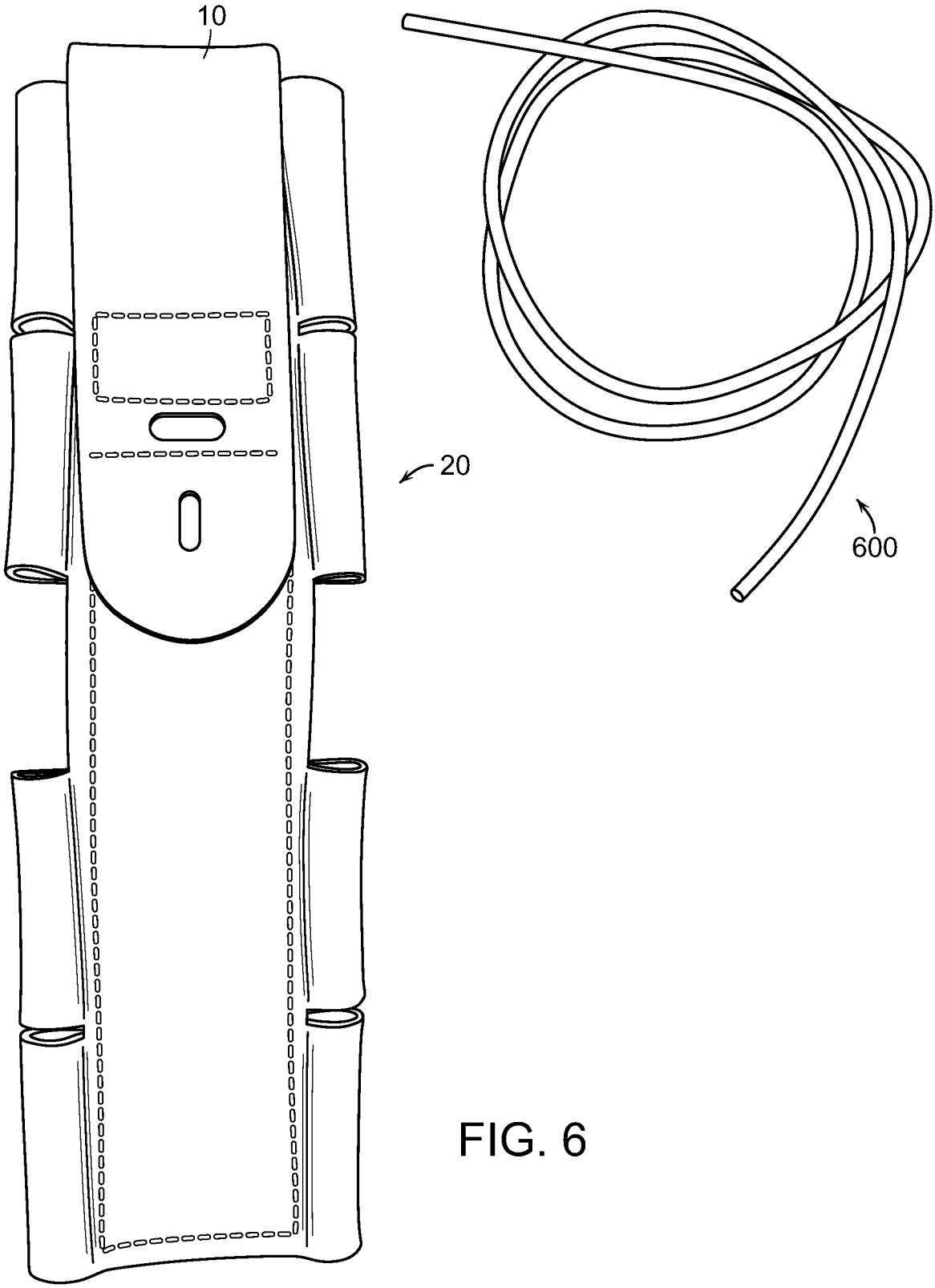
FIG. 6 is a back view of a partially assembled carrier from the pattern shown in FIG. 1.

Turning specifically to FIG. 8, the carrier in FIG. 6 is secured to a belt by threading the belt through the loop created on the backside by strap portion 10. An item is inserted into the top end and rests against the bottom end created by connector piece 30 and is compressed for a secure fit by the use of the elastic cord weaved through the channels 32 and 34, slots 22 and 24 and strap portion 10.

Figure 10:
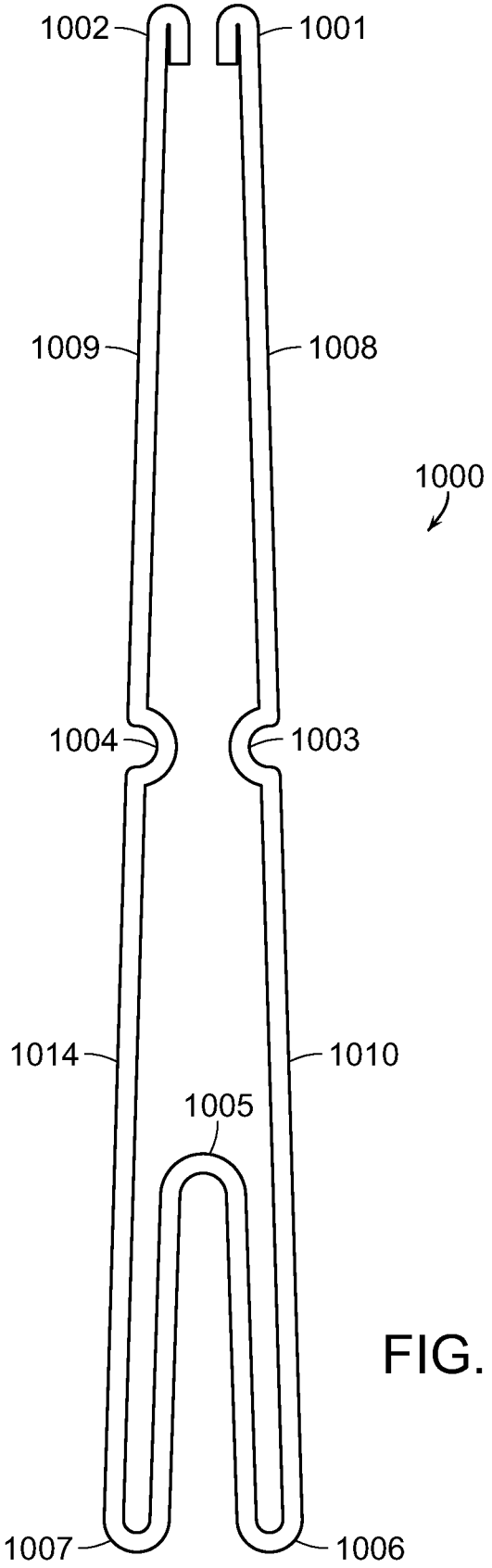
FIG. 10 is a front view of an exemplary version of the torsion spring of the present invention.
Figure 11:
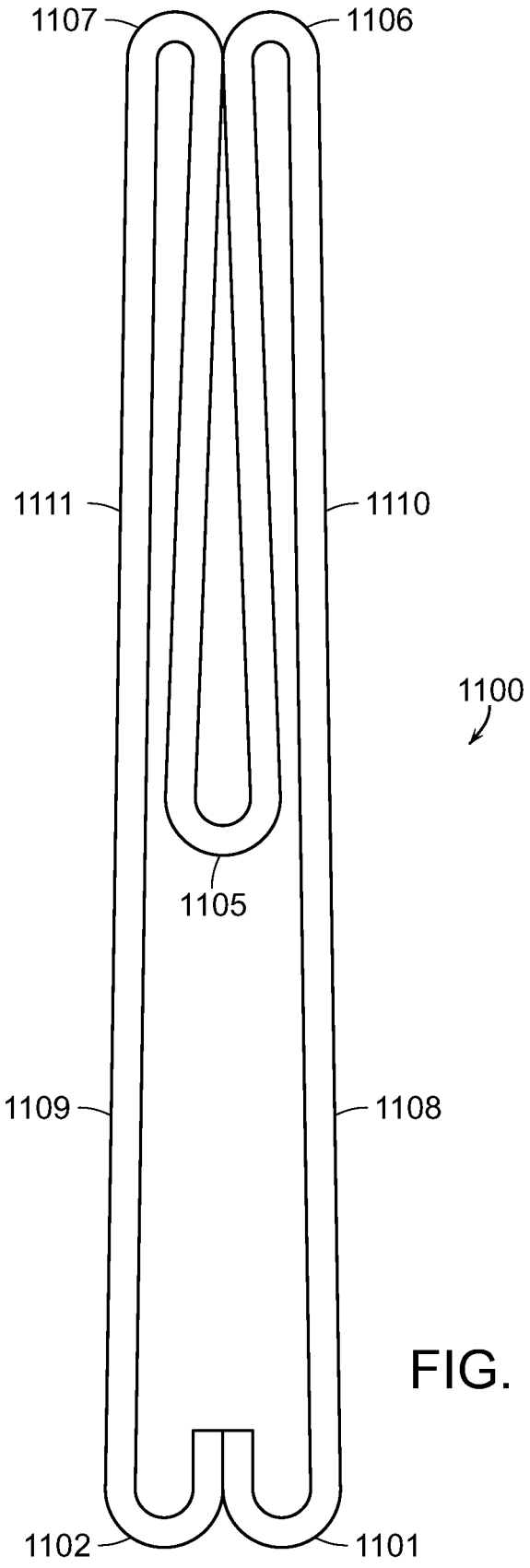
FIG. 11 is a front view of an exemplary version of the torsion spring of the present invention.

Turning to FIG. 10, a torsion spring with a "W" or "M" shaped end formed by portions 1005, 1006 and 1007, depending on orientation, has two opposing limbs with upper portions 1010 and 1014 and lower portions 1008 and 1009 curvatures 1003 and 1004 approximately midway between the upper and lower portions. The ends of the limbs of the torsion spring may have turn back hooks 1001 and 1002. As shown in FIG. 11, in an alternative embodiment, the torsion spring with a "W" or "M" shaped end formed by portions 1105, 1106 and 1107, depending on orientation, has two opposing limbs with upper portions 1110 and 1011 and lower portions 1108 and 1109 without any curvature midway.

Figure 12:
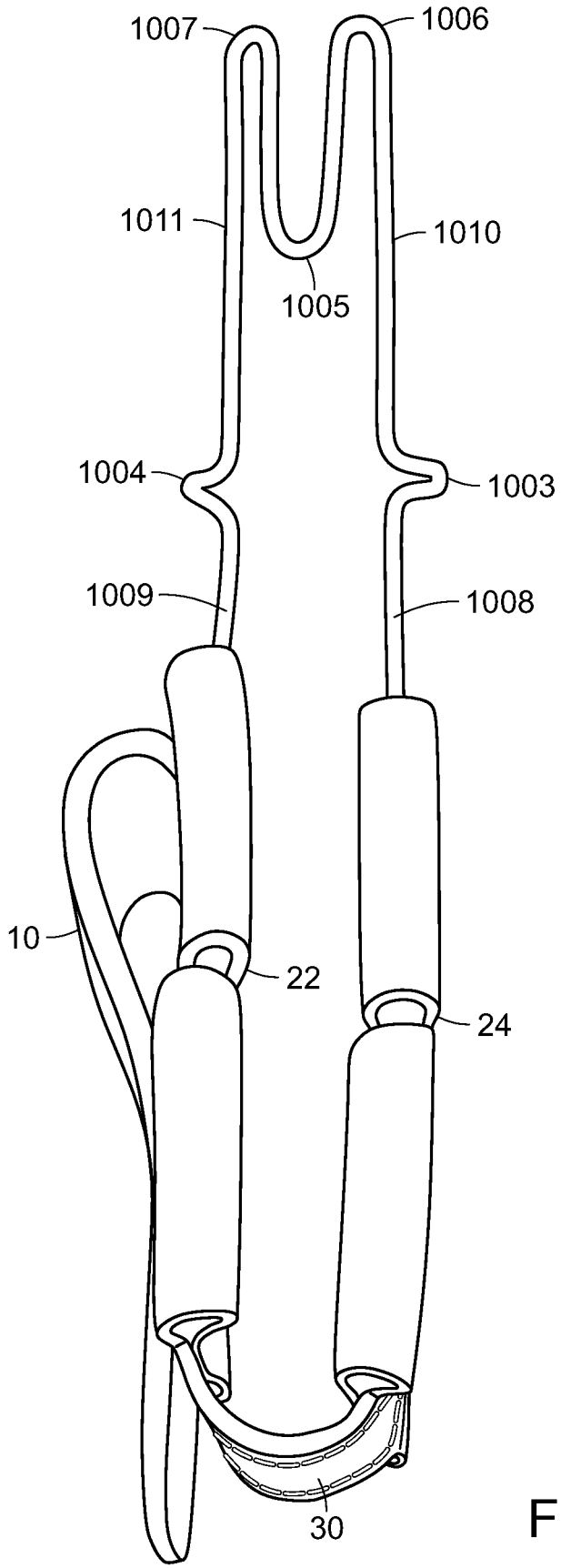
FIG. 12 illustrates a side view of the insertion of the torsion spring into one embodiment of the carrier of the present invention.

Turning to FIG. 12, a torsion spring with a "W" or "M" shaped end formed by portions 1005, 1006 and 1007 with two opposing limbs with upper portions 1010 and 1014 and lower portions 1008 and 1009 curvatures 1003 and 1004 approximately midway between the upper and lower portions is inserted into the formed channels 32 and 34 on each side entering from the bottom end of the carrier and passing through the side channels 32 and 34 towards the top end of the carrier.

Figure 13:
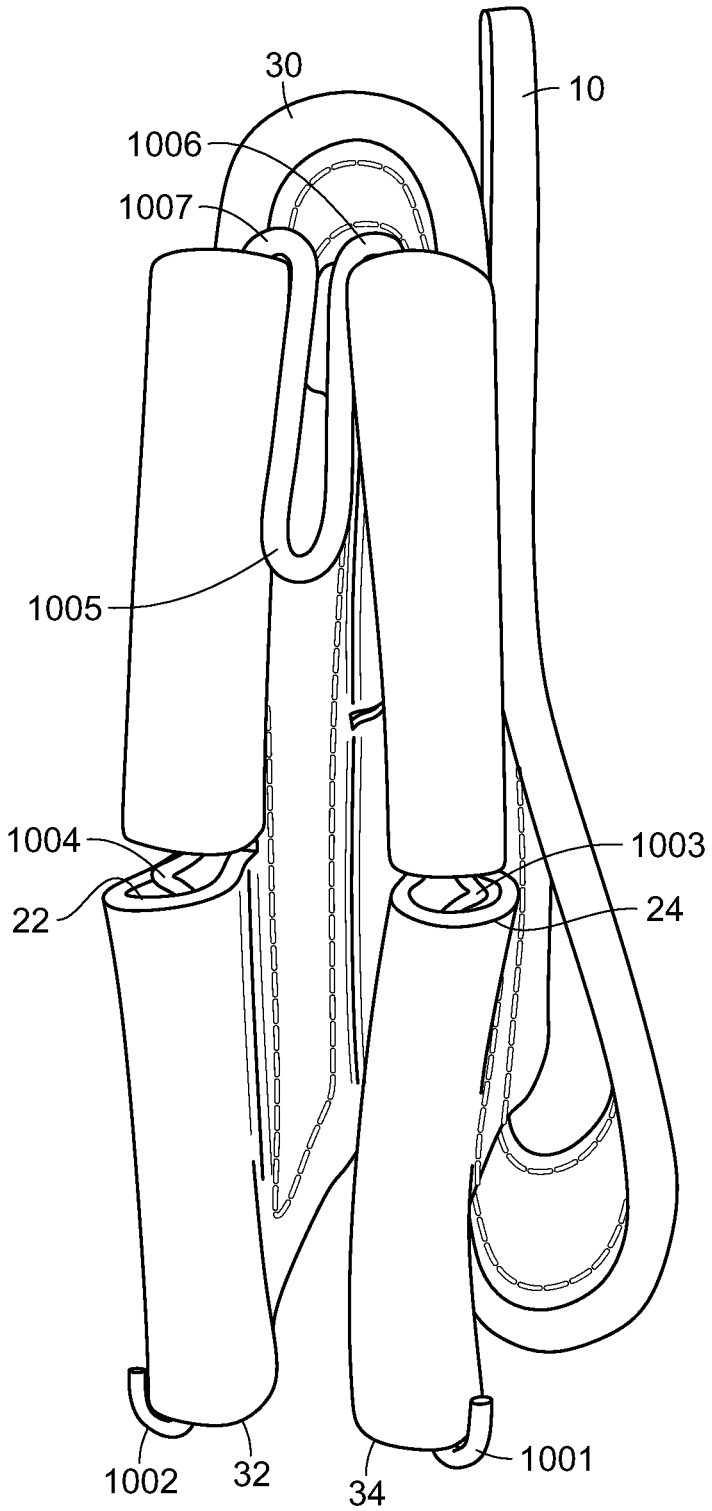
FIG. 13 illustrates a side view of the insertion of the torsion spring into one embodiment of the carrier of the present invention.

Turning to FIG. 13, the curvatures 1003 and 1004 midway inserts into the slots 22 and 24 of the channels 32 and 34, locking the limbs of the spring into place in the carrier. In an alternative embodiment, the torsion spring of FIG. 11 may also be inserted into the formed channels entering from the bottom end of the carrier and passing through the side channels 32 and 34 towards the top end of the carrier. An O-ring may be inserted at the midway point of each limb and fit within the slots 22 and 24 of the channels 120, locking the limbs into place in the carrier. When the torsion spring is in place, the opposing side walls of the carrier are compressed towards one another and also compressed against any item inserted into the interior cavity of the carrier.

As shown in FIG. 13, the ends 1001 and 1002 of the torsion spring may have turn back hooks that pass completely through the channels 32 and 34 and out the open top end of the carrier to help lock the spring in place.

While the torsion spring described herein is "W" or "M" shaped, the torsion spring may be of any shape such that the limbs can be inserted into the channels of the carrier an allows compression of the opposing sides of the carrier.

Figure 14:
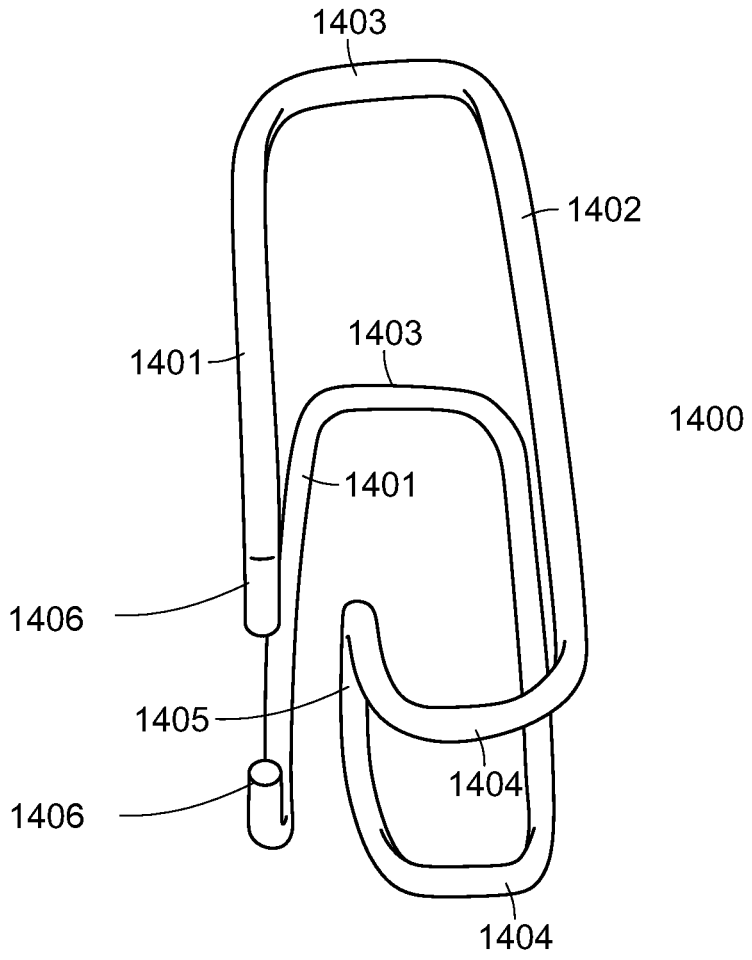
FIG. 14 is a perspective side view of an exemplary embodiment of the belt clip used with the carrier of the present invention.

Turning to FIG. 14, a wire form belt clip 1400 for use with the carrier of the preceding Figures is shown. In one embodiment, the wire form generally has a pair of straight legs 1401; a pair of straight legs 1402; a pair of side arms 1403 connecting the straight legs 1401 and 1402; a pair of curvilinear sections 1404 extending from legs 1402 and towards legs 1401 and ending in a hook configuration with side arm 1405 bridging the two curvilinear sections 1404. In the preferred embodiment, the legs 1401 and 1402 are substantially parallel to each other and substantially perpendicular to the side arms 1403. The curvilinear sections 1404 is substantially parallel to the side arm 1403 and substantially perpendicular to legs 1401 and 1402. Turn back hooks 1406 extend from the straight legs 1401 and are bent at about a 90-degree angle.

Figure 15A:
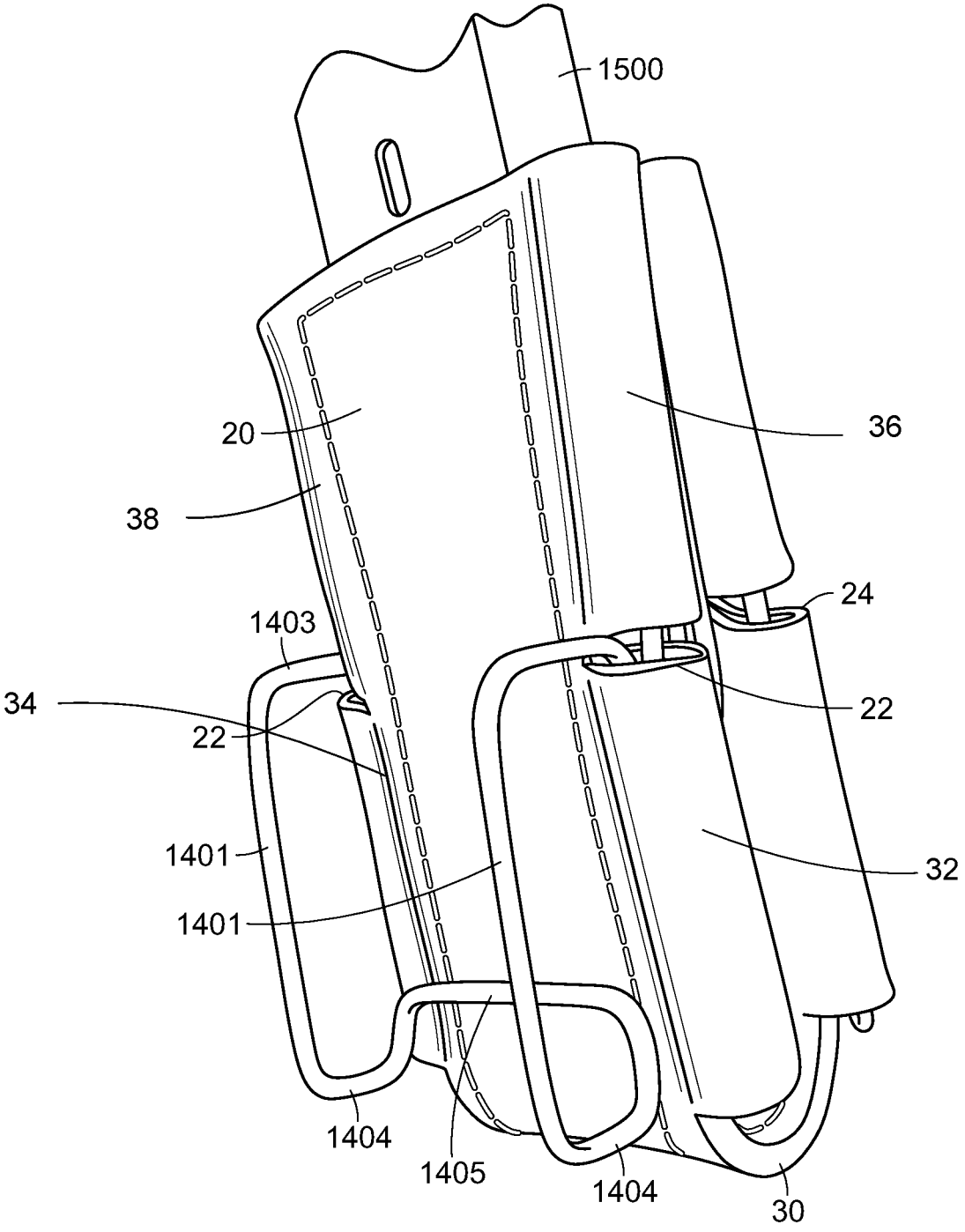
FIG. 15A is a perspective rear view of one position of insertion of the belt clip of FIG. 14 into the carrier of the present invention.

Turning to FIGS. 15A and B, the tips of the belt clip can be inserted into one of the channels 32/34 or 36/38 such that the legs 1410 and 1402 rest inside the channels 32 and 34 and the legs 1401 extend away from the magazine carrier between the side arms 1403 and curvilinear sections 1404. The side arm 1405 abuts the magazine carrier. A slotted space is created between the legs 1401 and 1402 of the belt clip.

Figure 15B:
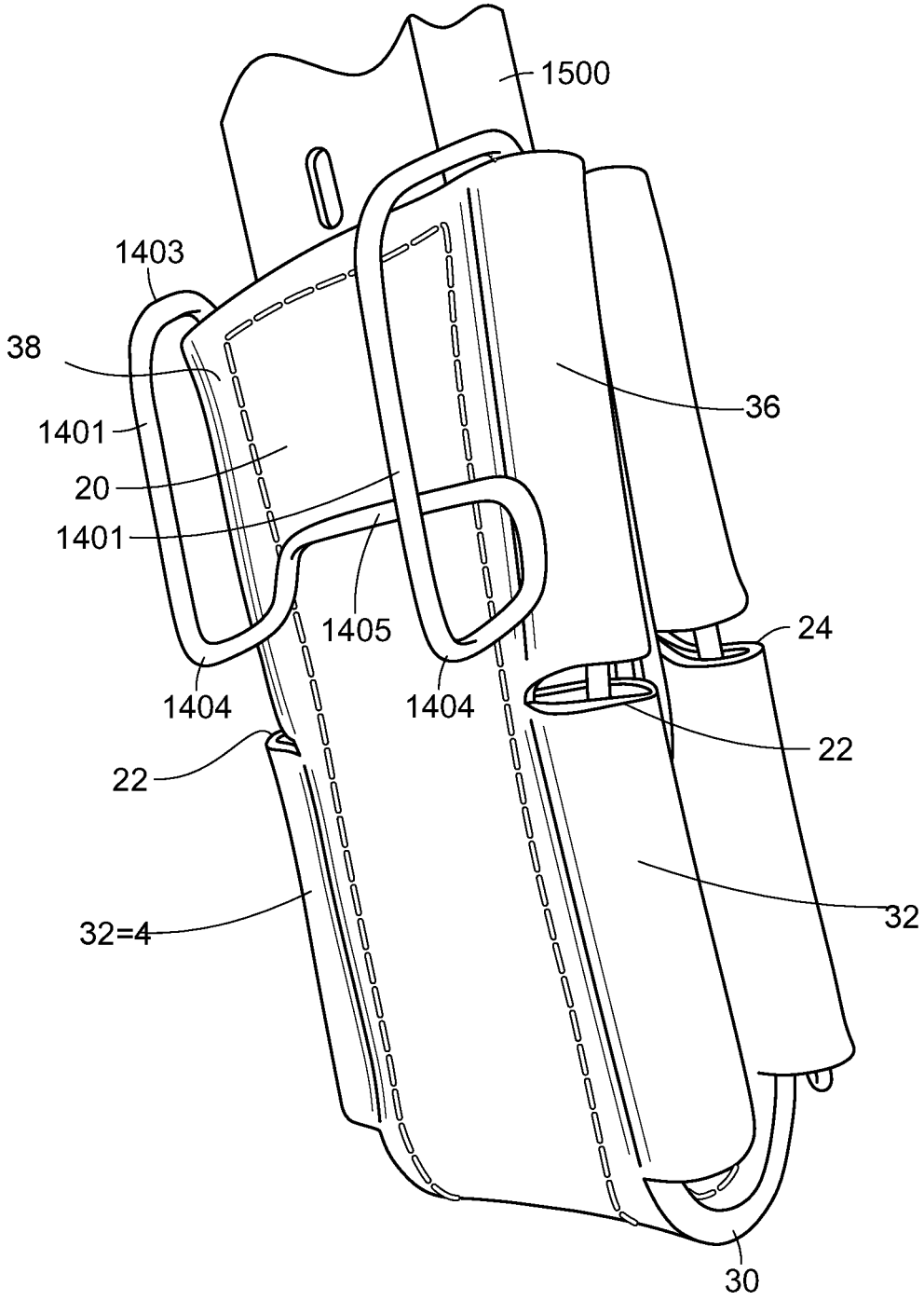
FIG. 15*b* is a perspective rear view of one position of insertion of the belt clip of FIG. 14 into the carrier of the present invention.
Figure 16:
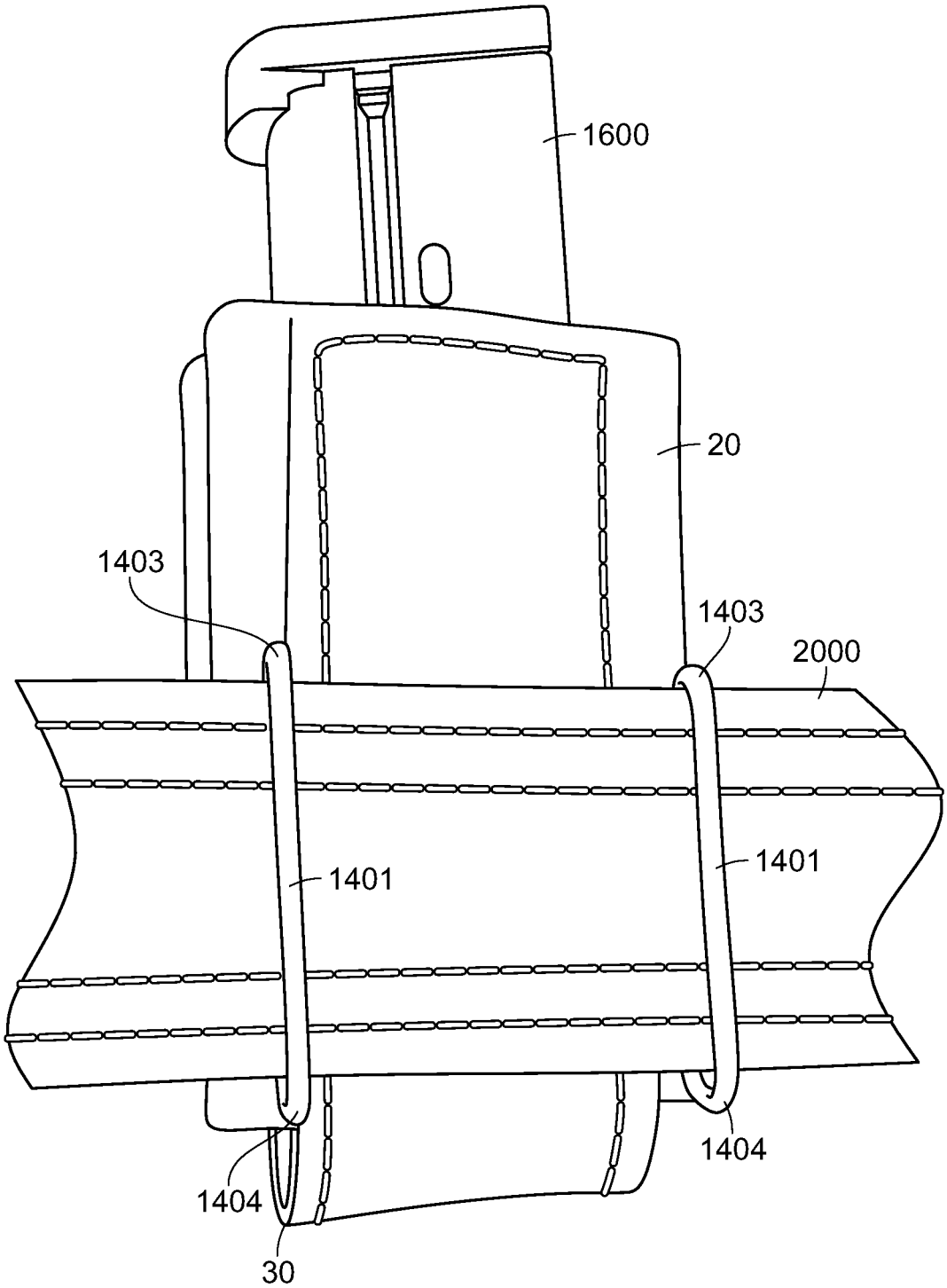
FIG. 16 is a rear view of the belt clip of FIG. 14 inserted into the carrier of the present invention and clipped to a belt.
Figure 17:
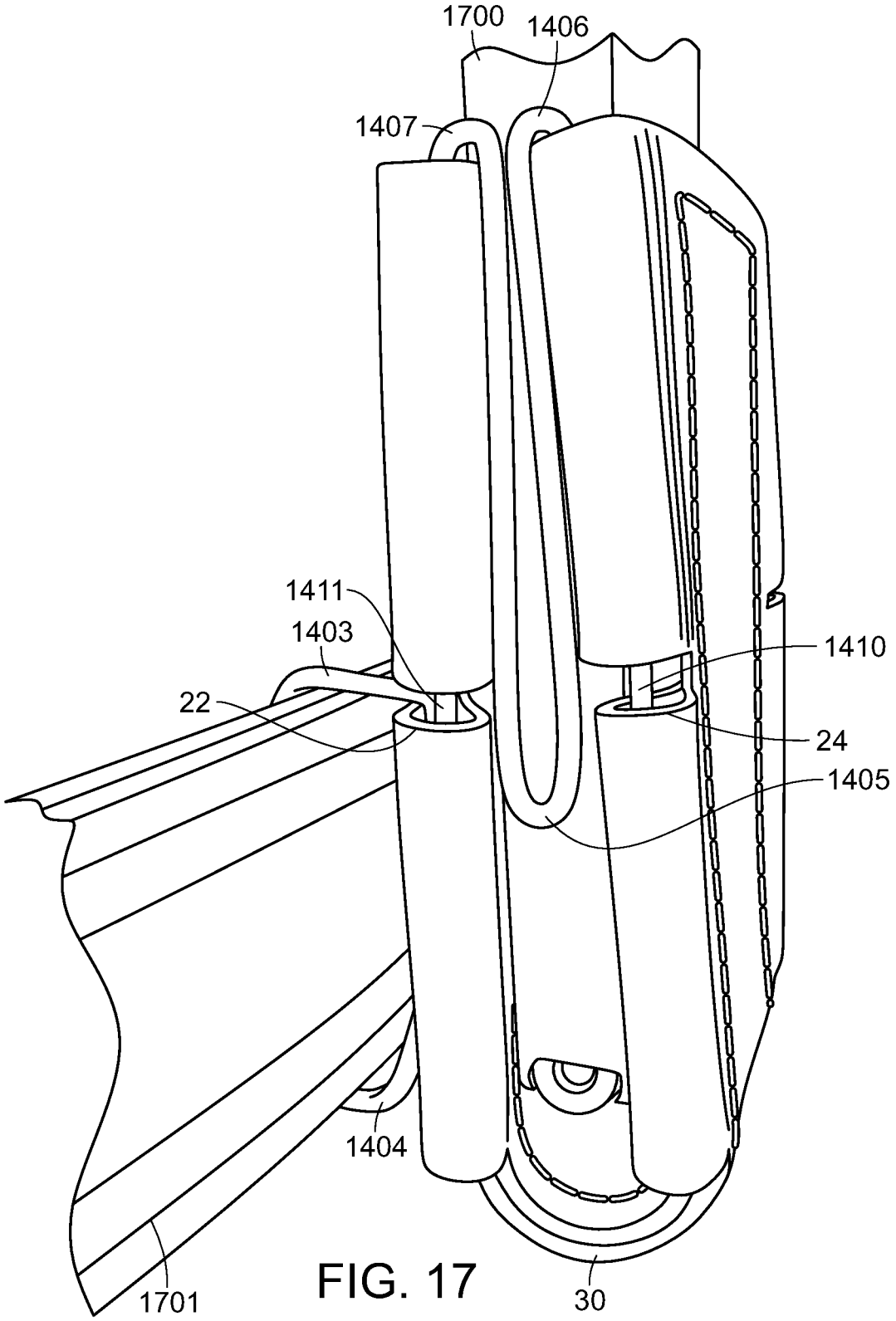
FIG. 17 is a side view of the belt clip of FIG. 14 inserted into the carrier of the present invention and clipped to a belt.
Figure 18:
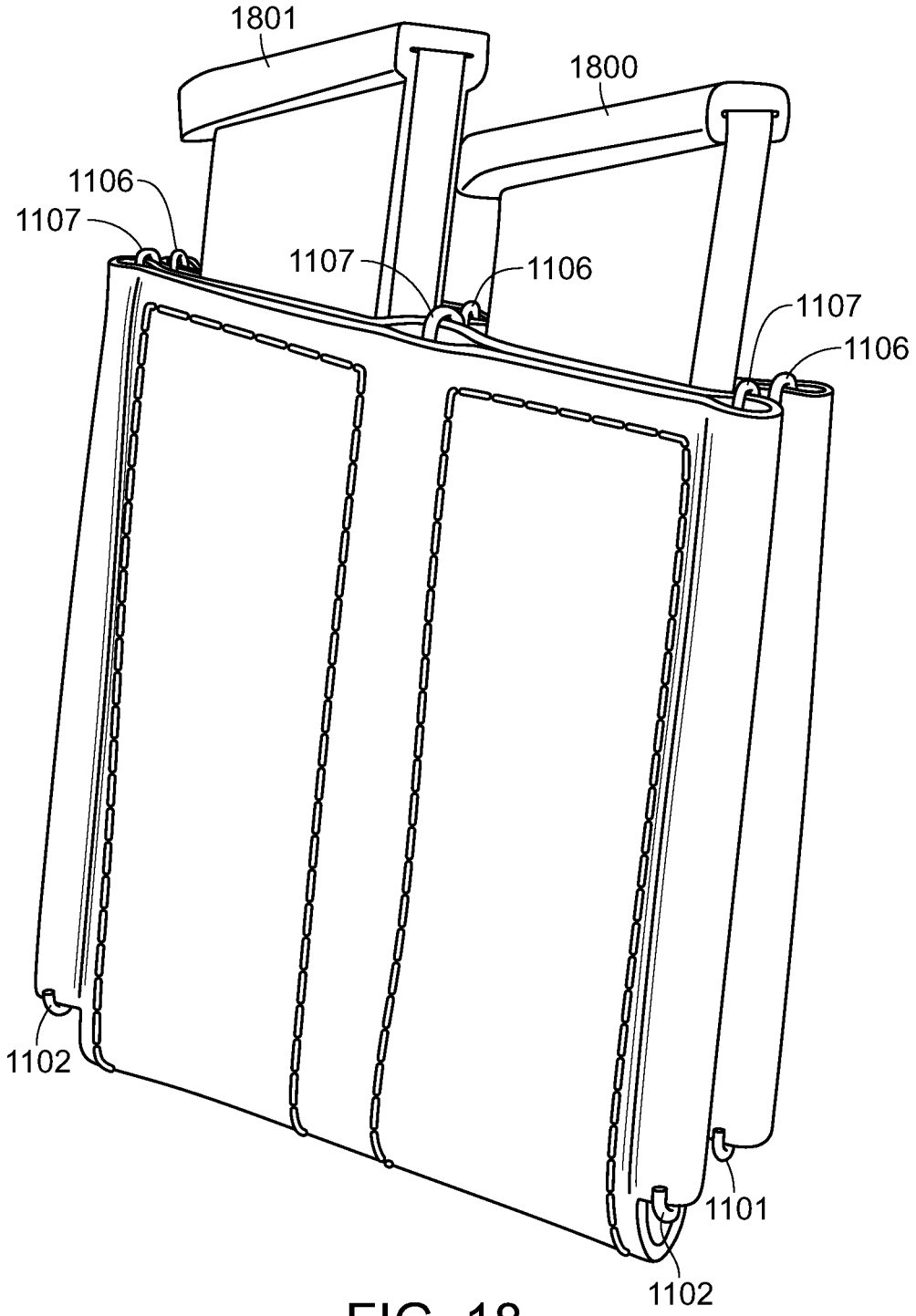
FIG. 18 is a perspective front view of two pouches of one embodiment of the carrier of the present invention in a series relationship.

Turning to FIGS. 16 and 17, a belt is shown threaded through the slotted space created between the legs 1401 and 1402 of the belt clip shown in FIG. 15.

Figure 19:
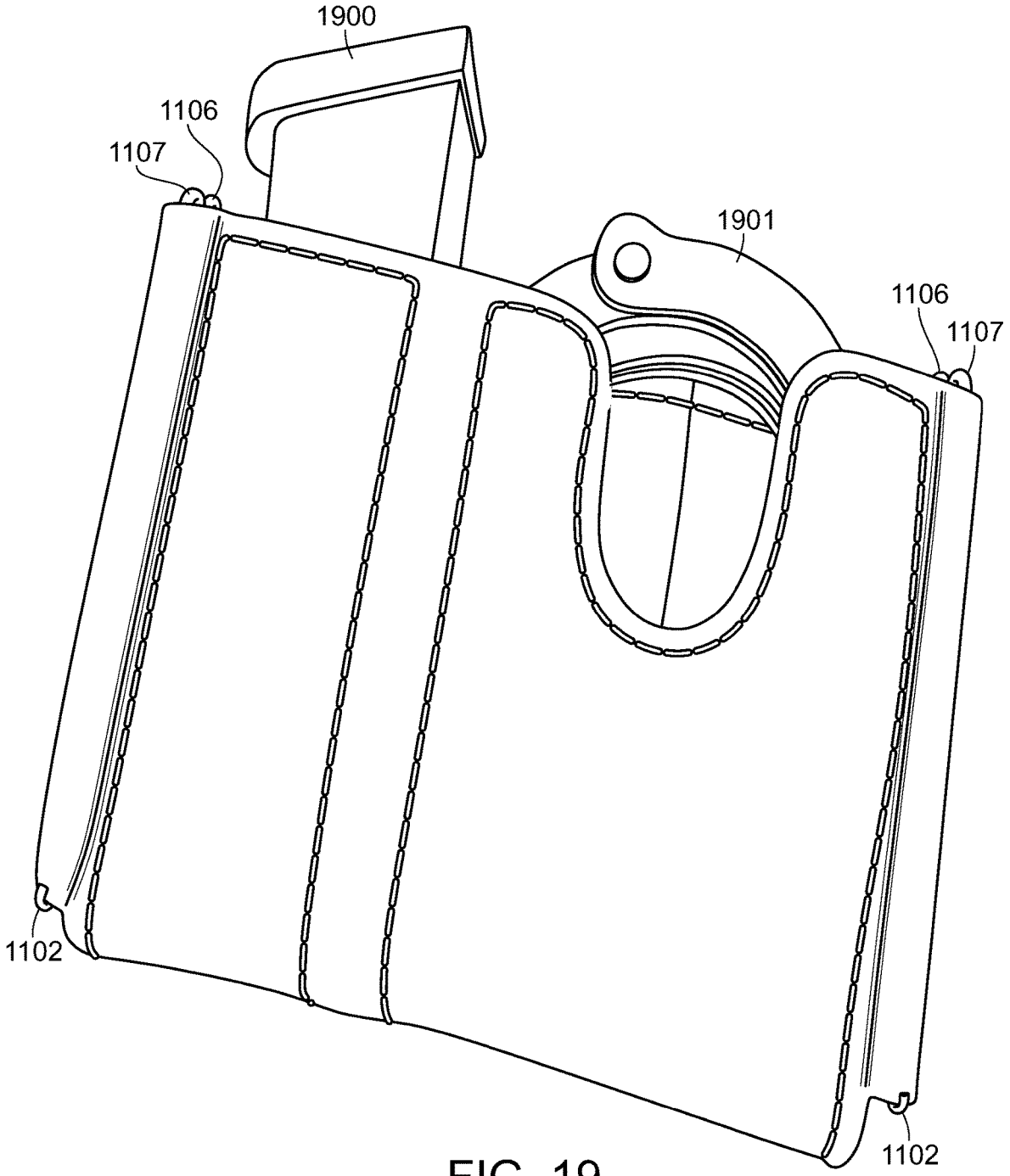
FIG. 19 is a perspective front view of two pouches of one embodiment of the carrier of the present invention in a series relationship.
Figure 20:
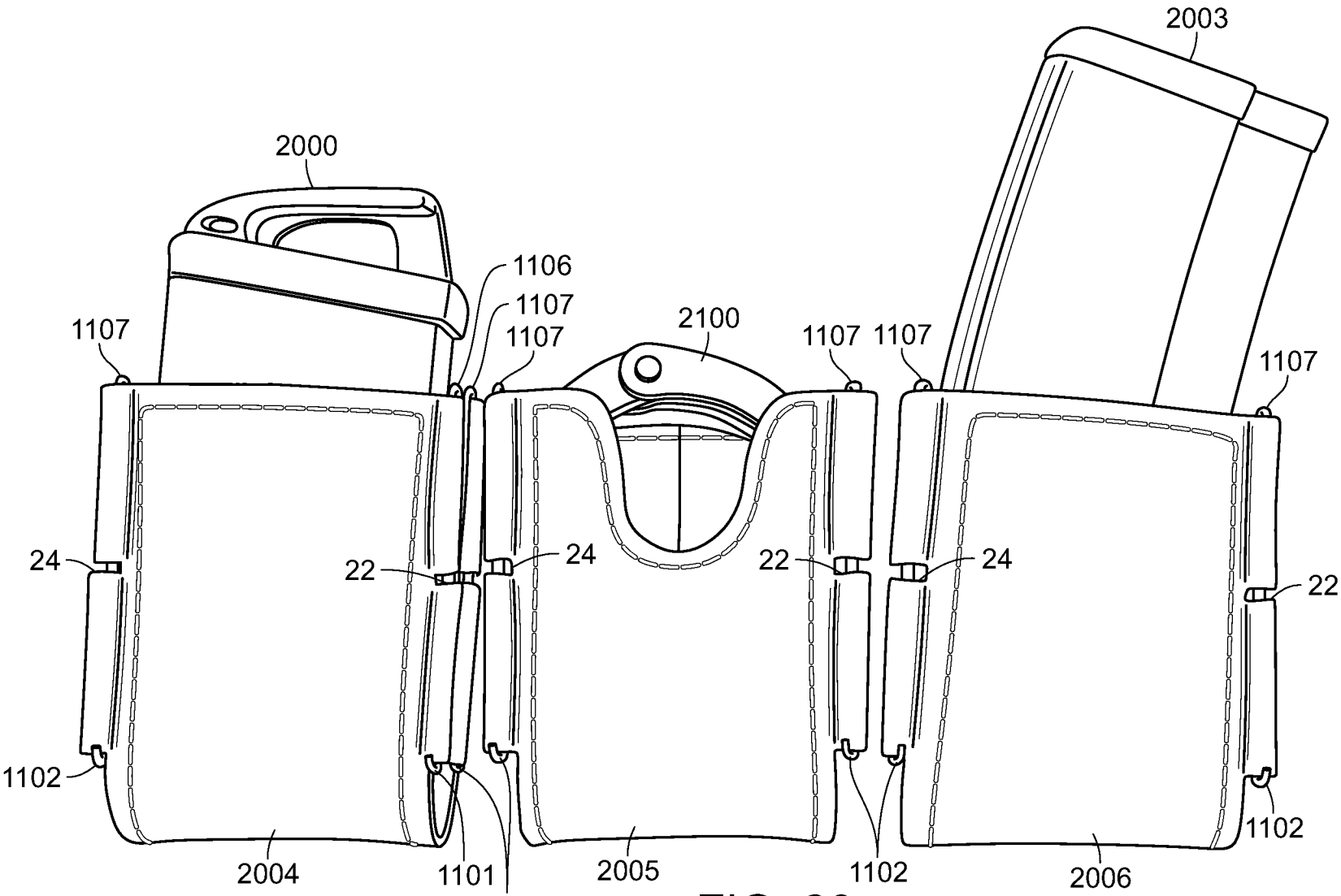
FIG. 20 is a perspective front view of three pouches of one embodiment of the carrier of the present invention in a series relationship.

Turning to FIGS. 19-20, an alternative embodiment of the carrier of the present invention is shown where two pouches are in a series relationship. A top portion and bottom portion of each pouch 20 are folded along their interior surface to meet a medial vertical axis of the pattern to create channels 32 and 34. The apertures in the top and bottom portions create slots 22 and 24 along the edges of channels 32 and 34. A torsion spring with a "W" or "M" shaped end formed by portions 1006 and 1007 with two opposing limbs are inserted into the formed channels 32 and 34 on each side entering from the bottom end of the pouches and passing through the side channels 32 and 34 towards the top end of the pouches. A pair of curvatures midway through the opposing limbs may be inserted into the slots 22 and 24 of the channels 32 and 34, locking the limbs of the spring into place in the pouches. However, as shown herein the torsion spring of FIG. 11 is inserted into the formed channels 32 and 34 of each pouch entering from the bottom end of the pouches and passing through the side channels 32 and 34 towards the top end of the pouches. When the torsion springs are in place, the opposing side walls of the pouches are compressed towards one another and also compressed against any item inserted into the interior cavity of the carrier, such as the ammunition clip 2003, the handcuffs 2100 and accessory 2000 of FIG. 20.

Figure 21:
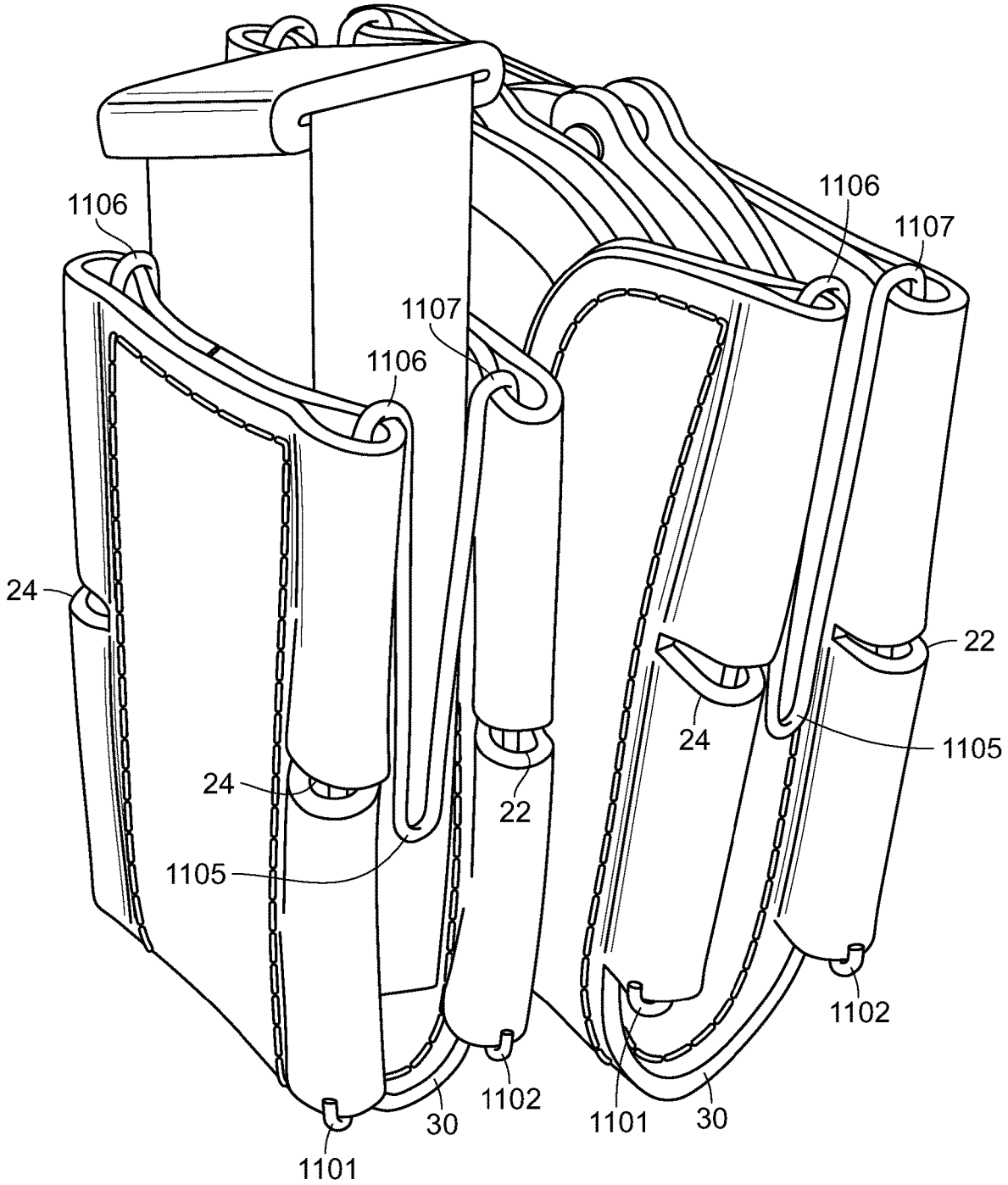
FIG. 21 is a side perspective view of two pouches of one embodiment of the carrier of the present invention in a stacked relationship.

Turning to FIG. 21, an alternative embodiment of the carrier of the present invention is shown where two pouches are in a stacked relationship. A top portion and bottom portion of each pouch are folded along their interior surface to meet a medial vertical axis of the pattern to create channels 32 and 34. The apertures in the top and bottom portions create slots 22 and 24 along the edges of channels 32 and 34. A torsion spring with a "W" or "M" shaped end formed by portions 1005, 1006 and 1007 with two opposing limbs are inserted into the formed channels 32 and 34 on each side entering from the bottom end of the pouches and passing through the side channels 32 and 34 towards the top end of the pouches. A pair of curvatures midway through the opposing limbs may be inserted into the slots 22 and 24 of the channels 32 and 34, locking the limbs of the spring into place in the pouches. However, as shown herein the torsion spring of FIG. 11 is inserted into the formed channels 32 and 34 of each pouch entering from the bottom end of the pouches and passing through the side channels 32 and 34 towards the top end of the pouches. When the torsion springs are in place, the opposing side walls of the pouches are compressed towards one another and also compressed against any item inserted into the interior cavity of the carrier.

As shown in FIG. 13, the ends 1001 and 1002 of the torsion spring may have turn back hooks that pass completely through the channels 32 and 34 and out the open top end of the carrier to help lock the spring in place.

While the torsion spring described herein is "W" or "M" shaped, the torsion spring may be of any shape such that the limbs can be inserted into the channels of the carrier or pouch an allows compression of the opposing sides of the carrier or pouch disclosed herein.

Figure 22:
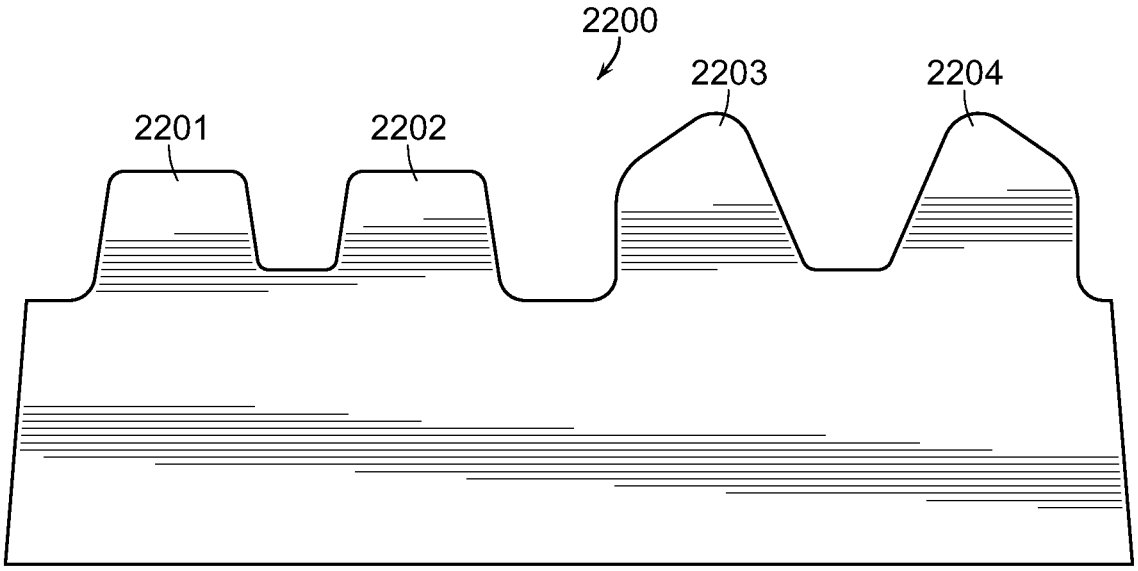
FIG. 22 is a front view of one embodiment of the pattern for the single continuous sheet of material for one embodiment of the present invention.
Figure 23:
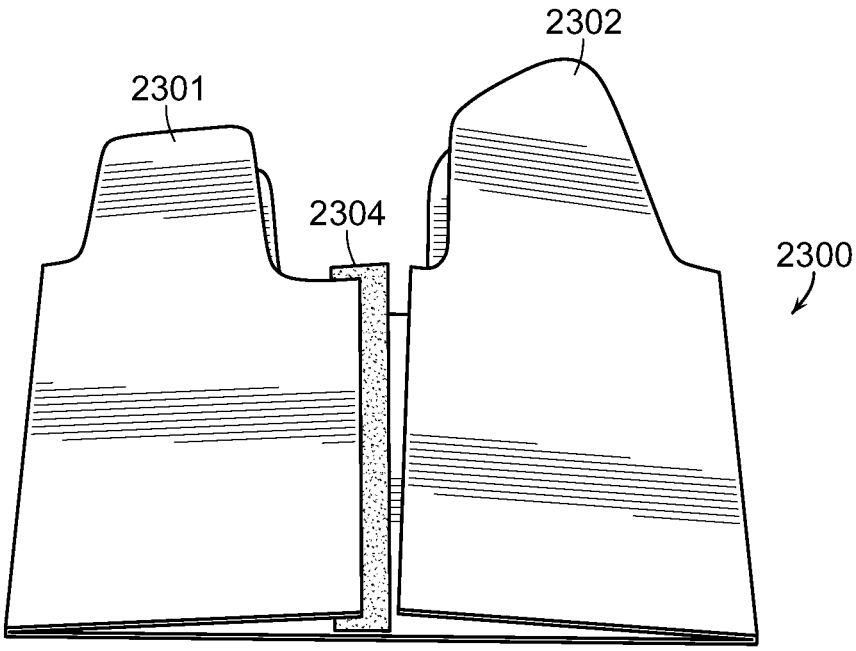
FIG. 23 is a front view of a partially assembled carrier from the pattern shown in FIG. 22.
Figure 24:
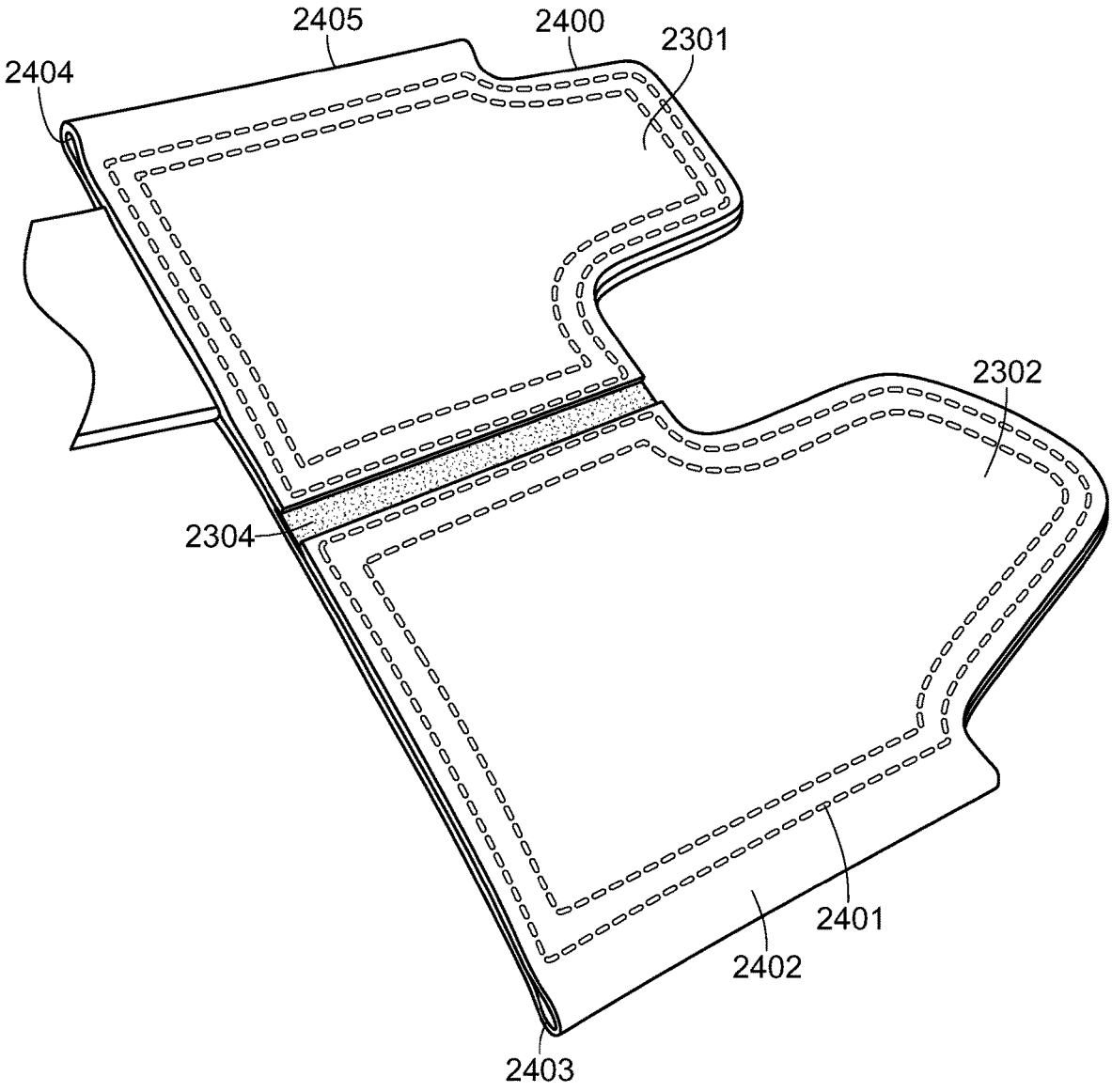
FIG. 24 is a front view of a partially assembled carrier from the pattern shown in FIG. 22.

Turning to FIG. 22, one embodiment of the pattern used to cut the material of the carrier disclosed herein is shown. As shown in FIGS. 23 and 24, the left portion 2301 and right portion 2302 of the carrier 2303 are folded along their interior surface to meet a medial vertical axis of the pattern to create channels 2403 and 2404 and opposing top open ends and opposing bottom open ends when the left 2301 and right 2302 sides are further folded towards the central vertical axis 2304 to create opposing side walls, said side walls 2402 and 2403 shown further in FIGS. 25 and 26 with a channels 2403 and 2404 at the outer edge of the each of the side walls 2402 and 2403. The channels 2403 and 2404 are secured in place by stitching the folded pieces of the left portion 2405 and right portion 2302 using seam 2401. The channel 2403 and edges of the side wall 2402 and 2403 create a gap, which provides a guide and protective area for the iron sights of a firearm.

Figure 26:
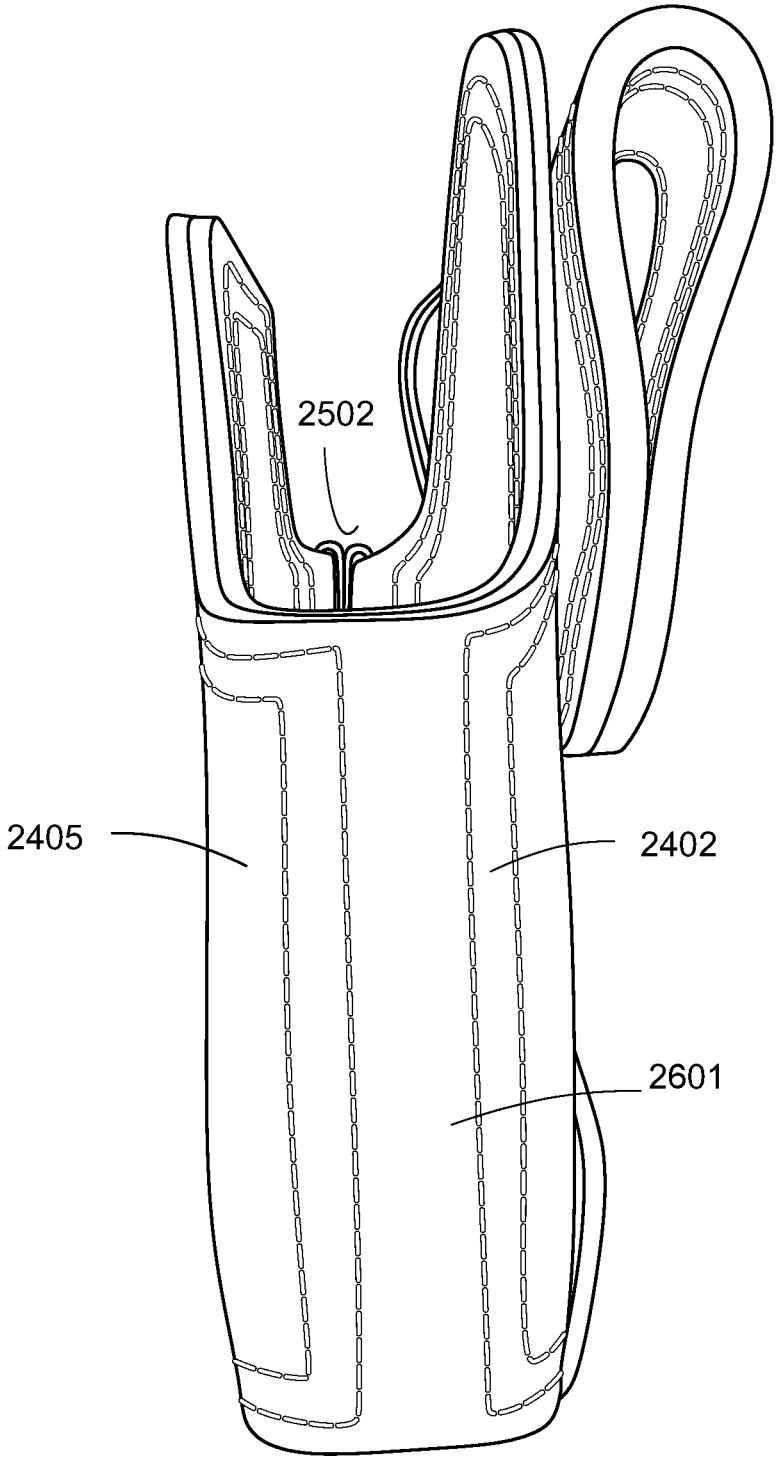
FIG. 26 is a back view of a fully assembled carrier from the pattern shown in FIG. 22.

As shown further in FIG. 26, a back spine portion 2601 is created. This spine may be reinforced by a portion of material 2304 shown in FIG. 23. In the preferred embodiment, the carrier is made from leather and the strip of material 2304 is made from plastic. The strip reinforces and protects the interior portion of the spine 2601 opposite channel 2403 when an item, such as a firearm with iron sights, is inserted into the carrier.

As shown in FIG. 26, a first torsion spring 2502, such as that shown in FIG. 11, is inserted through the channels at the outer edges of the opposing side walls 2402 and 2405 at the top or bottom open end of the carrier to force the opposing side walls towards each other.

Figure 25:
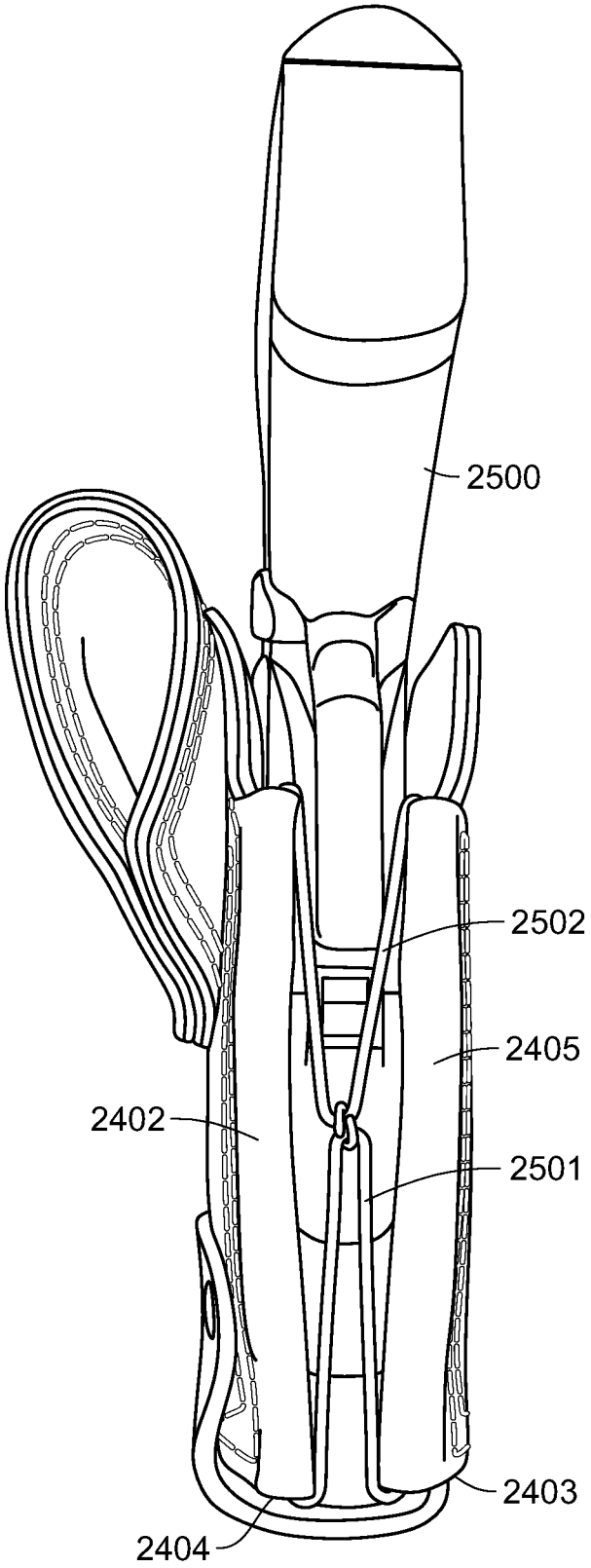
FIG. 25 is a front view of a fully assembled carrier from the pattern shown in FIG. 22.

As shown in FIG. 25, a second torsion spring 2501 may be interlaced with the first torsion spring 2502 at a central point of both torsion springs wherein a positive compression grip of an item inserted in the carrier is created by inserting the first spring 2502 through the channels 2303 and 2304 at the top open end of a first side wall 2402 and the top open end of the second side wall 2405 and inserting the second spring 2501 through the channels 2303 and 2304 at the bottom open end of the first side wall 2402 and at the bottom open end of the second side wall 2405 to force the now opposing side walls towards each other.

For the purposes of promoting an understanding of the principles of the invention, reference has been made to the preferred embodiments illustrated in the drawings, and specific language has been used to describe these embodiments. However, this specific language intends no limitation of the scope of the invention, and the invention should be construed to encompass all embodiments that would normally occur to one of ordinary skill in the art. The particular implementations shown and described herein are illustrative examples of the invention and are not intended to otherwise limit the scope of the invention in any way. For the sake of brevity, conventional aspects of the method (and components of the individual operating components of the method) may not be described in detail. Furthermore, the connecting lines, or connectors shown in the various figures presented are intended to represent exemplary functional relationships and/or physical or logical couplings between the various elements. It should be noted that many alternative or additional functional relationships, physical connections or logical connections might be present in a practical device. Moreover, no item or component is essential to the practice of the invention unless the element is specifically described as "essential" or "critical". Numerous modifications and adaptations will be readily apparent to those skilled in this art without departing from the spirit and scope of the present invention.

What is claimed is:

1. A multi-purpose carrier comprising:

a single continuous sheet of material with a left and right side folded along a central vertical axis of the sheet to create opposing top and bottom open ends and wherein the left and right sides are further folded towards the central vertical axis to create opposing side walls with a channel at an outer edge of each of the side walls;

a first torsion spring wherein a positive compression grip of an item inserted in the carrier is created by inserting the torsion spring through the channels at the outer edges of the opposing side walls at the top or bottom open end of the carrier to force the opposing side walls towards each other; and a second torsion spring interlaced with the first torsion spring at a central point of both torsion springs wherein a positive compression grip of an item inserted in the carrier is created by inserting the first spring of the pair of opposing torsion springs through the channel at the top open end of the first opposing side wall and the top open end of the second opposing side wall and inserting the second spring of the pair of opposing torsion springs through the channel at the bottom end of the first opposing side wall and the bottom end of the second opposing side wall to force the opposing side walls towards each other.

2. The carrier of claim 1 wherein the torsion springs have a "W" or "M" shaped end with two opposing limbs extruding therefrom.

3. The carrier of claim 2 wherein opposing ends of the limbs of the torsion springs have turn back hooks that pass completely through the channels and out the open top and bottom ends of the carrier to lock the springs in place.

* * * * *